US011230122B2

(12) United States Patent
Schuster et al.

(10) Patent No.: US 11,230,122 B2
(45) Date of Patent: Jan. 25, 2022

(54) MULTIPLE ZONE PRINTER VACUUM TABLES, SYSTEMS AND METHODS

(71) Applicant: Electronics for Imaging, Inc., Fremont, CA (US)

(72) Inventors: Brett Schuster, Hollis, NH (US); Donald B. Richardson, Atkinson, NH (US); Keith R. Vaillancourt, Hudson, NH (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 0 days.

(21) Appl. No.: 15/604,381

(22) Filed: May 24, 2017

(65) Prior Publication Data

US 2017/0341425 A1 Nov. 30, 2017

Related U.S. Application Data

(60) Provisional application No. 62/341,283, filed on May 25, 2016.

(51) Int. Cl.

| | |
|---|---|
| ***B41J 11/00*** | (2006.01) |
| ***B65H 5/22*** | (2006.01) |
| ***B41J 3/28*** | (2006.01) |

(52) U.S. Cl.

CPC ..... *B41J 11/0085* (2013.01); *B41J 3/28* (2013.01); *B41J 11/001* (2013.01); *B41J 11/007* (2013.01); *B65H 5/224* (2013.01); *B65H 2406/362* (2013.01); *B65H 2406/42* (2013.01)

(58) Field of Classification Search

None

See application file for complete search history.

(56) References Cited

U.S. PATENT DOCUMENTS

| | | | | |
|---|---|---|---|---|
| 3,536,005 | A | 10/1970 | Derrickson | |
| 4,494,433 | A * | 1/1985 | Gerber | B08B 15/00 83/100 |
| 6,216,848 | B1 | 4/2001 | Zens | |
| 6,607,336 | B1 * | 8/2003 | Suzuki | B23Q 1/032 269/21 |
| 8,235,491 | B2 * | 8/2012 | Williams | B41J 3/28 347/104 |

(Continued)

FOREIGN PATENT DOCUMENTS

| | | |
|---|---|---|
| CA | 2926409 A1 | 5/2015 |
| EP | 0571370 B1 | 3/1995 |

*Primary Examiner* — Alejandro Valencia

(74) *Attorney, Agent, or Firm* — Perkins Coie LLP

(57) ABSTRACT

Disclosed are printer vacuum tables, and corresponding systems and methods for their use, in which the printer vacuum tables include multiple zones to apply vacuum, to hold a variety of media types and thicknesses within a given flatness range, to allow high definition printing. The vacuum zones run in the print direction, and each can be controlled for vacuum on and off. In an illustrative embodiment, the vacuum zones include one or more vacuum zones that are fixed with respect to a printer vacuum table surface, and one or more variable vacuum zones that are movable with respect to the printer vacuum table surface. One or more of the vacuum zones can be turned off if the print media does not cover the zone, such as to prevent leakage, and to provide more consistent vacuum hold down, regardless of media size or width.

21 Claims, 16 Drawing Sheets

(56) References Cited

U.S. PATENT DOCUMENTS

| | | | | |
|---|---|---|---|---|
| 8,360,545 | B2 * | 1/2013 | Houjou | B41J 2/155<br>347/104 |
| 9,283,789 | B2 * | 3/2016 | Ueda | B41J 11/007 |
| 2002/0110400 | A1 * | 8/2002 | Beehler | B41J 11/0025<br>400/635 |
| 2003/0038420 | A1 | 2/2003 | Cleary et al. | |
| 2011/0139577 | A1 | 6/2011 | Panides et al. | |
| 2011/0317144 | A1 | 12/2011 | Baxter | |
| 2013/0171351 | A1 | 7/2013 | Vekstein et al. | |

* cited by examiner

MULTIPLE ZONE PRINTER VACUUM TABLES, SYSTEMS AND METHODS

CROSS-REFERENCE TO RELATED APPLICATIONS

This Application claims priority from U.S. Provisional Application No. 62/341,283, filed May 25, 2016, which is incorporated herein in its entirety by this reference thereto.

FIELD OF THE INVENTION

At least one embodiment of the present invention pertains to a printer vacuum table having multiple zones for the applying vacuum to constrain a media, and a corresponding method for its implementation. At least one embodiment of the present invention pertains to a six zone printer vacuum table.

BACKGROUND

Media often include non-planar features which can be problematic for printing. For instance, paper, paperboard, corrugated cardboard, and other large media substrates, are often bowed, e.g., in either a convex or concave manner, or can include other non-planar features, in one or more dimensions, with respect to a printer. As well, such media can include other non-uniform irregularities, such as inherent to their manufacture, and/or based on their packaging, distribution, handling, and/or storage. Single-pass printing systems can be used for a wide variety of printing applications. However, in currently available single-pass printing systems, it is not possible to hold a variety of non-planar media types and thicknesses within a given flatness range to allow high definition printing.

BRIEF DESCRIPTION OF THE DRAWINGS

One or more embodiments of the present invention are illustrated by way of example and not limitation in the figures of the accompanying drawings, in which like references indicate similar elements.

DETAILED DESCRIPTION

References in this description to "an embodiment", "one embodiment", or the like, mean that the particular feature, function, structure or characteristic being described is included in at least one embodiment of the present invention. Occurrences of such phrases in this specification do not necessarily all refer to the same embodiment. On the other hand, the embodiments referred to also are not necessarily mutually exclusive.

Introduced here is are technique that allow the printing of high quality graphic on a variety of media having non-planar features, using a plurality of printing zones, in which one or more of the printing zones are variable in position with respect to a printer vacuum table, and in which the vacuum applied to the printing zones is controllable.

In certain embodiments, the technique introduced here involves the following sequence of actions, as described more fully below. One or more parameters of the media to be printed are determined or otherwise established, such as based on any of media width, media type, media thickness, media condition, and/or any combination thereof. The printer vacuum table is then physically configured for printing if necessary, such as based on the media width and media location/position. One or more of the vacuum zones can then be enabled or disabled for subsequent printing, such as based on the width and alignment of the media within a printing region.

Various exemplary embodiments will now be described. The following description provides certain specific details for a thorough understanding and enabling description of these examples. One skilled in the relevant technology will understand, however, that some of the disclosed embodiments may be practiced without many of these details.

Likewise, one skilled in the relevant technology will also understand that some of the embodiments may include many other obvious features not described in detail herein. Additionally, some well-known structures or functions may not be shown or described in detail below, to avoid unnecessarily obscuring the relevant descriptions of the various examples.

The terminology used below is to be interpreted in its broadest reasonable manner, even though it is being used in conjunction with a detailed description of certain specific examples of the embodiments. Indeed, certain terms may even be emphasized below; however, any terminology intended to be interpreted in any restricted manner will be overtly and specifically defined as such in this Detailed Description section.

Some embodiments of the invention concern a vacuum table that is used in single pass printing applications to hold a variety of media types and thicknesses within a given flatness range to allow high definition printing.

Figure 1:
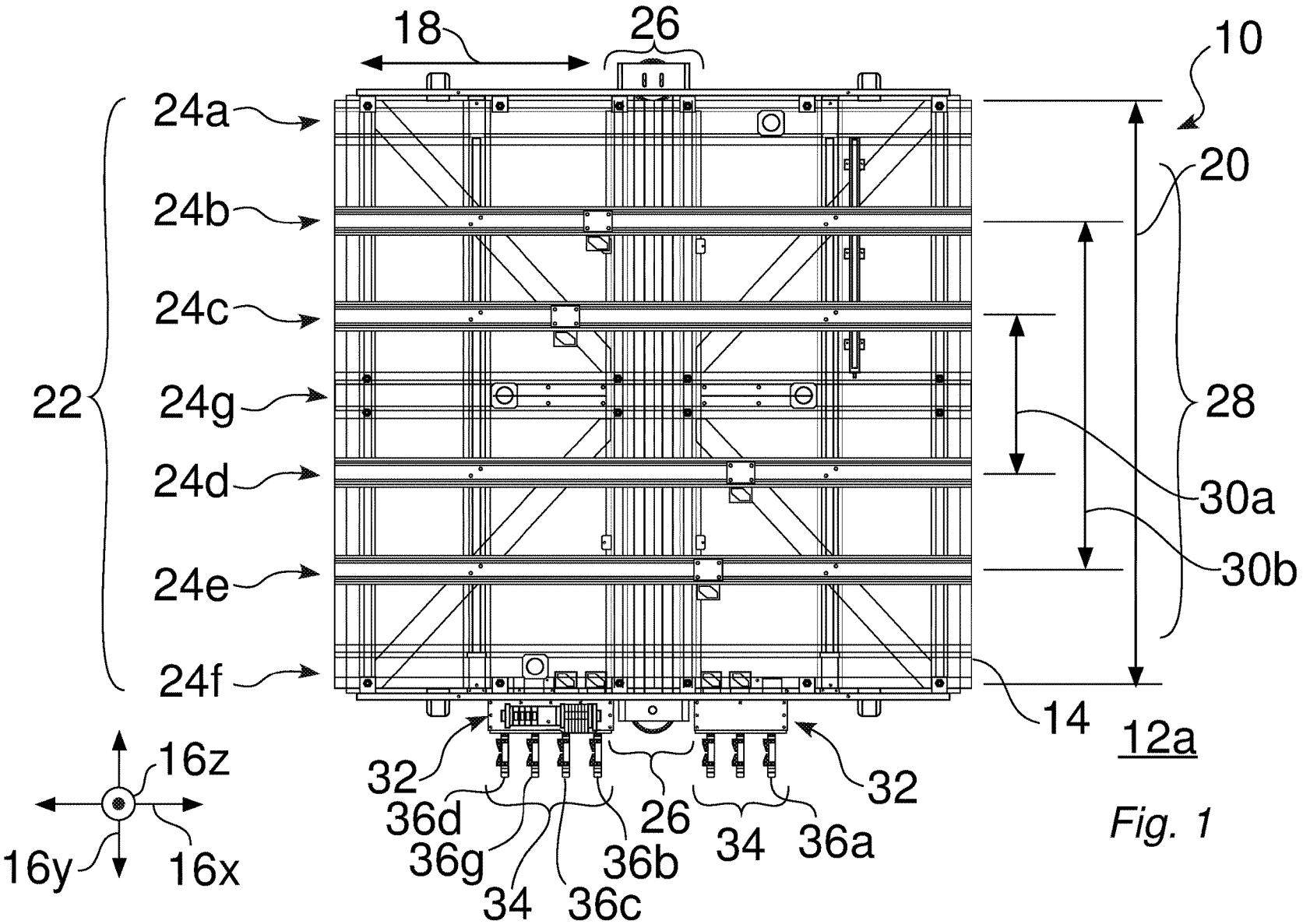
FIG. 1 is a schematic view of an illustrative embodiment of a multiple zone printer vacuum table.
Figure 2:
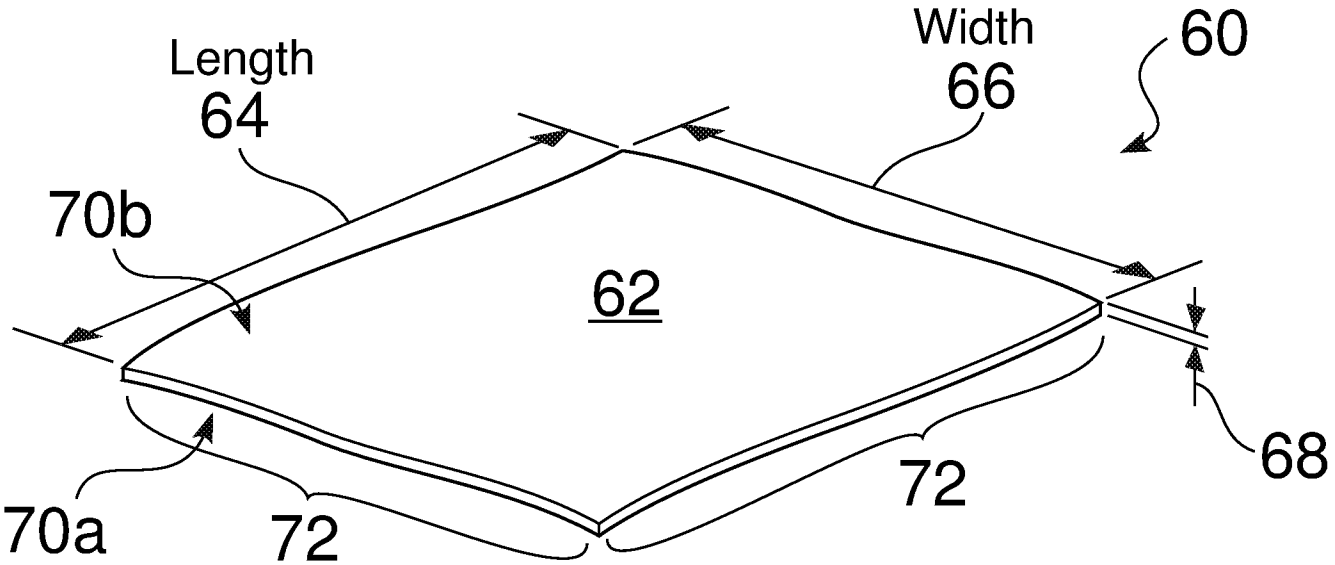
FIG. 2 is an illustrative view of print media, such as having a characteristic length, width, and thickness, and opposing surfaces, in which the media can include one or more non-planar features.

FIG. 1 is a schematic view 10 of a multiple zone printer vacuum table 12, e.g., 12*a*. The illustrative printer vacuum table 12 seen in FIG. 1 is configured to accept a variety of print media 62 (FIG. 2), such as having different media types and thicknesses 62 (FIG. 2). The illustrative embodiment shown in FIG. 1 includes a plurality of vacuum zones 22, such as comprising one or more fixed zones 24, e.g., 24*a*, 24*f* and 24*g*, and one or more variable zones 24, e.g., 24*b*, 24*c*, 24*d* and 24*e*, which can be moved transversely, e.g., along axis 16*y*, with respect to the width 20 of a printer vacuum surface 14. The printer vacuum surface 14 is typically permeable or can include holes, passages or conduits 130 (FIG. 4, FIG. 6, FIG. 7) defined therethrough, to transfer an applied vacuum 122 (FIG. 3) to a media 62, from one or more of the vacuum zones 24, in which each of the vacuum zones 24 include holes, passages or conduits 132 (FIG. 4) defined therethrough for applying vacuum 122 from a vacuum source 116.

Figure 3:
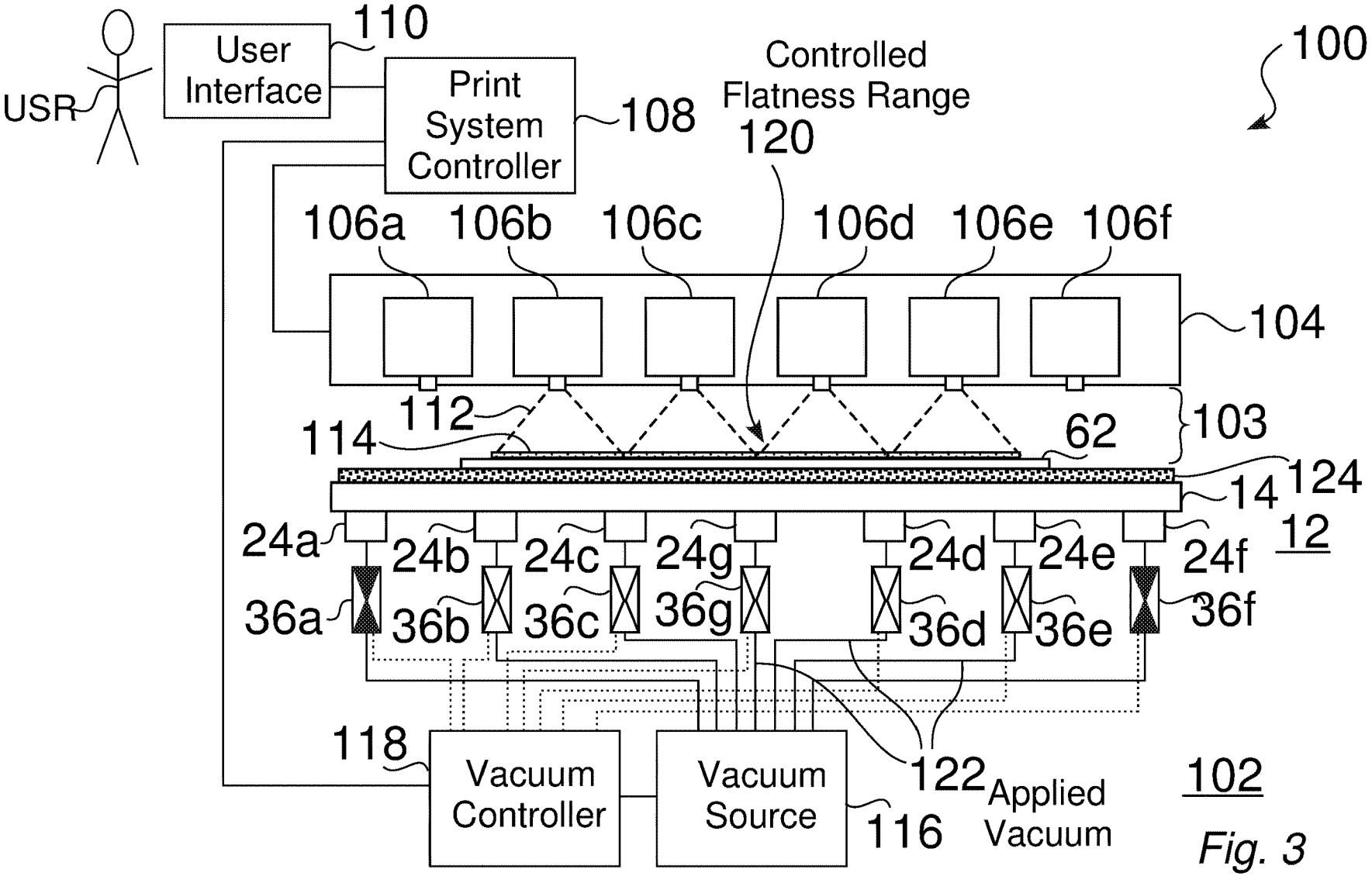
FIG. 3 is an end schematic view of media located within a printing region of an illustrative printing system having a printer vacuum table that includes a plurality of vacuum zones.

In some embodiments of the printer vacuum table 12, e.g., 12*a*, there are six distinct vacuum zones 24, e.g., 24*a*-24*f*, such as in addition to a central vacuum zone 24*g*, which run in the print direction 18, which can each be controlled 118 (FIG. 3) to apply vacuum 122, e.g., on and off. A vacuum zone 24 can be turned off or disabled if the media 62 does not cover the zone 24; this prevents leakage and allows for more consistent vacuum hold down 212 (FIG. 9), regardless of media size or width, and also allows use of smaller capacity blowers such as used for the vacuum source 116 (FIG. 3). In some embodiments of the printer vacuum table the vacuum source or blower 116 can provide varying amounts of vacuum 122, such as to increase the vacuum 122 for media that includes greater non-planar features. In some embodiments of the printer vacuum table 12, the amount of applied vacuum 122 can be varied between 0 percent (closed) and 100 percent (completely open) through one or more of the vacuum zones 24, such as compensate for the non-planar features of the media 62 to be printed.

Four of the vacuum zones 12 seen in FIG. 1, e.g., 12*b*-12*e*, can be moved in perpendicularly, e.g., 16*y*, to the print direction 18, e.g., 16*x*, to change where vacuum 122 is applied on the printer vacuum surface 14. This can guarantee that a single piece of media 62 (within the working range) always has at least three zones 24 applying vacuum 122 to it, e.g., one on either transverse edge, e.g., 146*a*, 146*b* (FIG. 8) of the media 62 and one at the center, e.g., 144 (FIG. 8), of the media 62. A drivetrain 26, such as controlled by a motor 306 (FIG. 14), e.g., a servo or stepper motor 306, allows an operator USR (FIG. 3, FIG. 14), such as through control 310 (FIG. 14), to move the variable vacuum zones 24 transversely 16*y*, such as to predefined locations 28 or separations 30, e.g., 30*a*, 30*b* between vacuum zones 24, quickly, such as based on media width 66 (FIG. 2), or based on an operator specified position. Feedback 312 (FIG. 14), such as from one or more encoders 308 (FIG. 14), can track the location of the variable zones 12 at all times.

An illustrative vacuum distribution system 32 is also shown in FIG. 1, which can include one or more vacuum manifolds and vacuum lines 34 to apply vacuum 122 to the plurality 22 of vacuum zones 24. The illustrative vacuum distribution system 32 seen in FIG. 1 includes a plurality of valves 36, e.g., 36*a*-36*g*, wherein each of the valves 36 corresponds to a respective one of the vacuum zones 24, such as to enable or disable the application of the vacuum 122, e.g., on/off, or in variable amounts of vacuum 122.

FIG. 2 is an illustrative view 60 of print media 62, such as having a characteristic length 64, width 66, and thickness 68, and opposing surfaces 70*a*, 70*b*. While the illustrative media 62 shown in FIG. 2 is shown as having a characteristic length 64, such as for printing of separate media items 62 within a printing region 103 (FIG. 3), other embodiments of the printer vacuum table systems 12 and printing systems 102 (FIG. 3) can be used for media 62 that is longer than the printer vacuum table 12, such as for media that is passes into the print region 103 from a transfer roll.

The first surface 70*b* of the illustrative media 62 shown in FIG. 2 can represent a surface 70 upon which graphics 114 (FIG. 3) are to be printed 112 (FIG. 3), while the opposing surface 70*a* can represent a surface 70 that can contact the printer vacuum surface 14 (or contacts a porous vacuum belt 124 (FIG. 3, FIG. 5) that is configured to transfer the media 62 in the print direction 18 through the printing region 103). In this manner, vacuum 122 can controllably be applied 118, such as to compensate for non-planar features 102 of the media 62.

Media 62 to be printed, such as paper, paperboard, corrugated cardboard, or other media, can often include surfaces 70 that are other than flat, such as including convex or concave features 72, or other features 72 that are either consistent to the media 62 or are specific to one or more specific media items 62. For instance, media 62 may often include convex or concave features 72 across its width 66 or length 64, such as based on a general characteristic of the media 62, or based on the particular characteristics of one or more separate media 62 to be printed.

FIG. 3 is an end schematic view 100 of media 62 located within a printing region 103 of a printing system 102 having a printer vacuum table 12 that includes a plurality 22 of vacuum zones 24, e.g., 24*a*-24*g*, wherein the print system 102 is configured to hold the media 62 with a flatness range 120 that allows high definition printing 112 on the upper surface 70*b* of the media 62.

Figure 4:
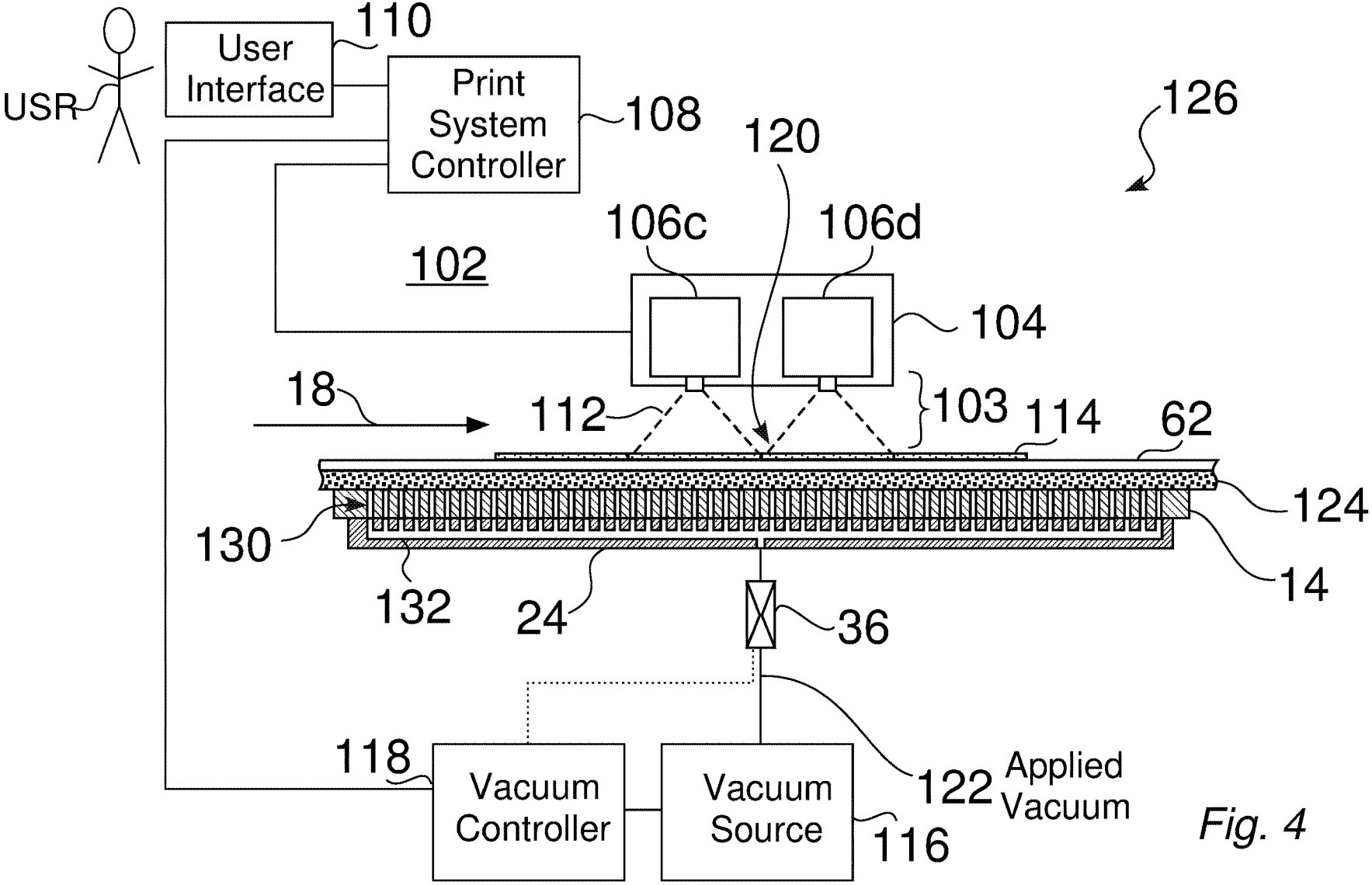
FIG. 4 is a side schematic view of media located within a printing region of an illustrative printing system having a printer vacuum table, in which the vacuum table is configured to apply vacuum to a substrate from a vacuum zone located below the printer table surface.

FIG. 4 is a side schematic view 126 of media 62 located within a printing region 103 of an illustrative printing system 102 having a printer vacuum table 12, in which the printer vacuum table 12 is configured to apply vacuum 122 to a substrate 62 from an illustrative vacuum zone 24 located below the printer vacuum surface 14. For instance, the illustrative printer vacuum surface 14 seen in FIG. 4 can be permeable or can include holes, passages or conduits 130 defined therethrough, to transfer an applied vacuum 122 to a media 62, from one or more of the vacuum zones 24, in which each of the vacuum zones 24 includes holes, passages or conduits 132 defined therethrough for applying vacuum 122, such as from the vacuum source 116.

The flatness range 120 of the media is accomplished by controlled application of vacuum 122 through one or more vacuum zones 24, such as vacuum zones 24 that coincide with the media 62 to be printed 112. For instance, the illustrative media 62 seen in FIG. 3 is shown as being center aligned 500, 520 (FIG. 18, FIG. 19) with respect to the width 20 of the printer vacuum surface 14, such that the media 62 is located over some of the plurality 22 of print zones 24, e.g., 24*b*, 24*c*, 24*g*, 24*d* and 24*e*. As also seen in FIG. 3, the center-aligned media 62 does not coincide with the peripheral vacuum zones 24*a* and 24*f*.

The illustrative printing system 102 seen in FIG. 3 includes a print head assembly 104, e.g., a print carriage 104, that includes one or more print heads 106, e.g., 106*a*-106*f*, for controllable delivery of ink 112, and a corresponding print system controller 108 and user interface 110 for interaction with a user, i.e., operator USR. The illustrative print head assembly 104 seen in FIG. 3 is shown as extending over the width 20 of the printer vacuum surface 14, and is stationary with respect to the printer vacuum table 12, for printing on media 62 as the media 62 is advanced on a porous transfer belt 124 in the print direction 18. In some embodiments of the printing system 102, the print head assembly or carriage 104 can be moved vertically, e.g., 16*z* (FIG. 1), such as to compensate for media 62 having an increased thickness 68 (FIG. 2).

The illustrative print system 102 seen in FIG. 3 includes a vacuum source 116, e.g., a vacuum blower 116, which can be controlled either locally, through a local controller 118, or from the print system controller 108, to apply vacuum 122 to one or more vacuum zones 24 that are enabled. For instance, vacuum zones 24*b*, 24*c*, 24*d*, 24*e* and 24*g* shown in FIG. 3 are enabled to apply vacuum 122 through corresponding open valves 36*b*, 36*c*, 36*d*, 36*e* and 36*g*, respectively, while vacuum zones 24*a* and 24*f* shown in FIG. 3 are disabled to apply vacuum 122 through corresponding closed valves 36*a* and 36*f*, respectively, because vacuum zones 24*a* and 24*f* do not coincide with the media 62 within the printing region 103.

Figure 5:
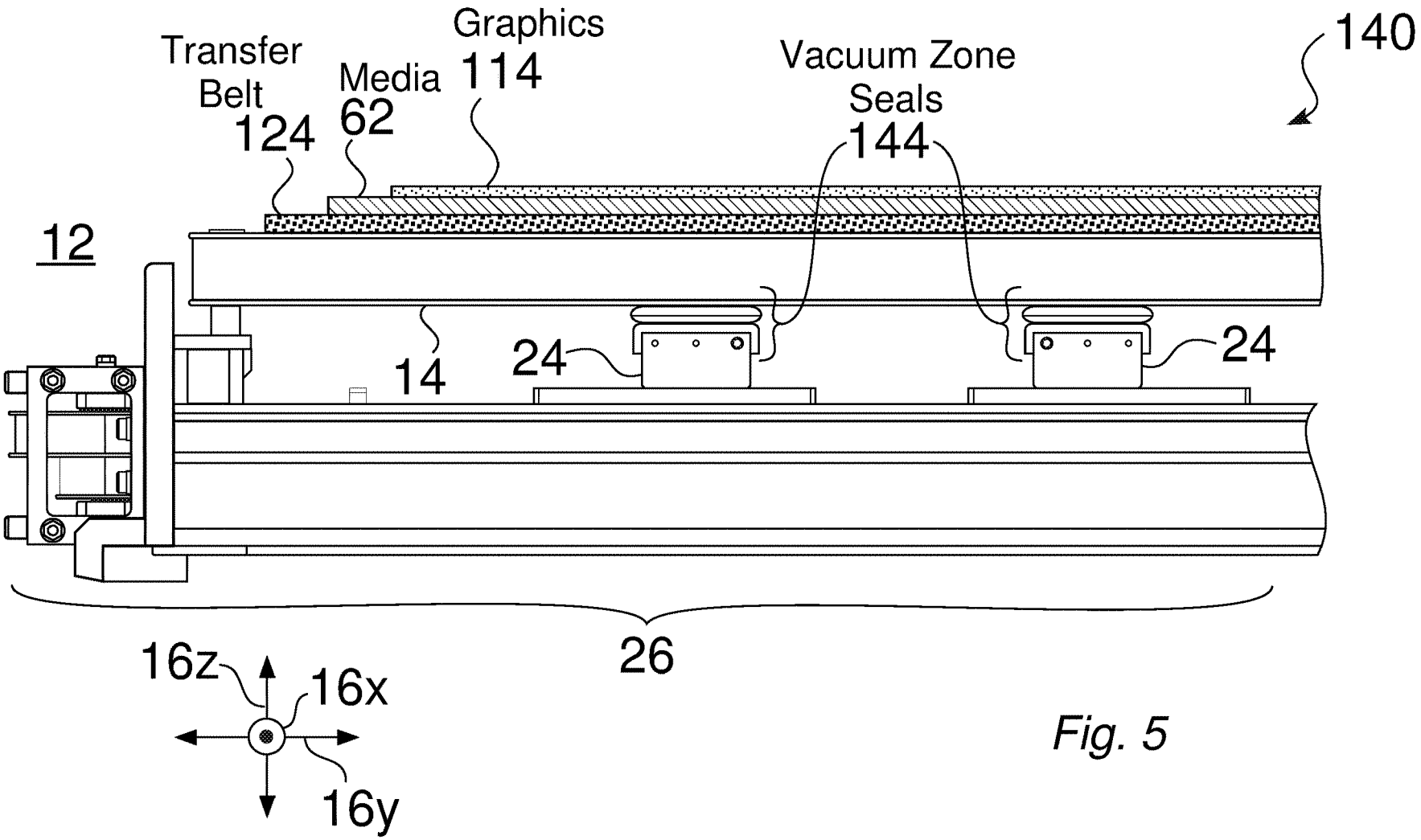
FIG. 5 is a partial detailed cutaway view of an illustrative printer vacuum table, which shows a porous transfer belt used to move media in a print direction though a printing region, and also shows vacuum zone seals that can be used for vacuum zones that are movable with respect to the printer vacuum surface.

FIG. 5 is a partial detailed cutaway view 140 of an illustrative printer vacuum table 12, which shows a porous transfer belt 124 that is typically used to transfer media 62 in a print direction 18 though a printing region 103, and also shows vacuum seals 144 corresponding to the movable vacuum zones 24. The porous vacuum belt 124 allows vacuum from the fixed and movable vacuum zones 24 to be applied to constrain the media, while the seals 144, which are fixed to the movable vacuum zones 24, e.g., 24*b*-24*e* (FIG. 1), are configured to reduce or eliminate leakage of vacuum 122 that is applied to the printer vacuum surface 14.

Figure 6:
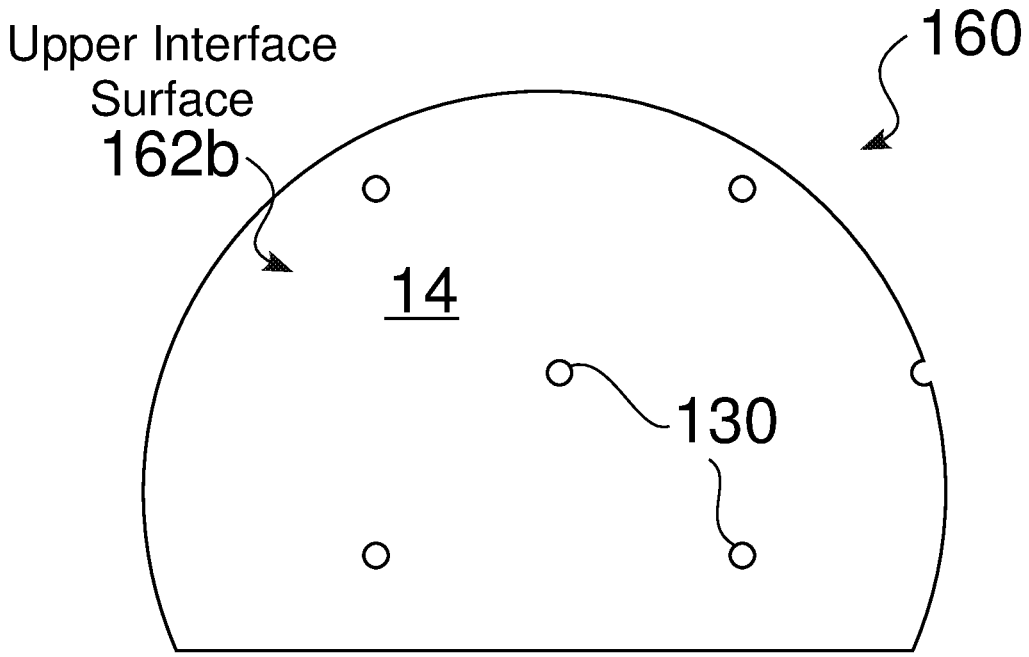
FIG. 6 shows details of an upper interface surface of an illustrative printer vacuum surface.
Figure 7:
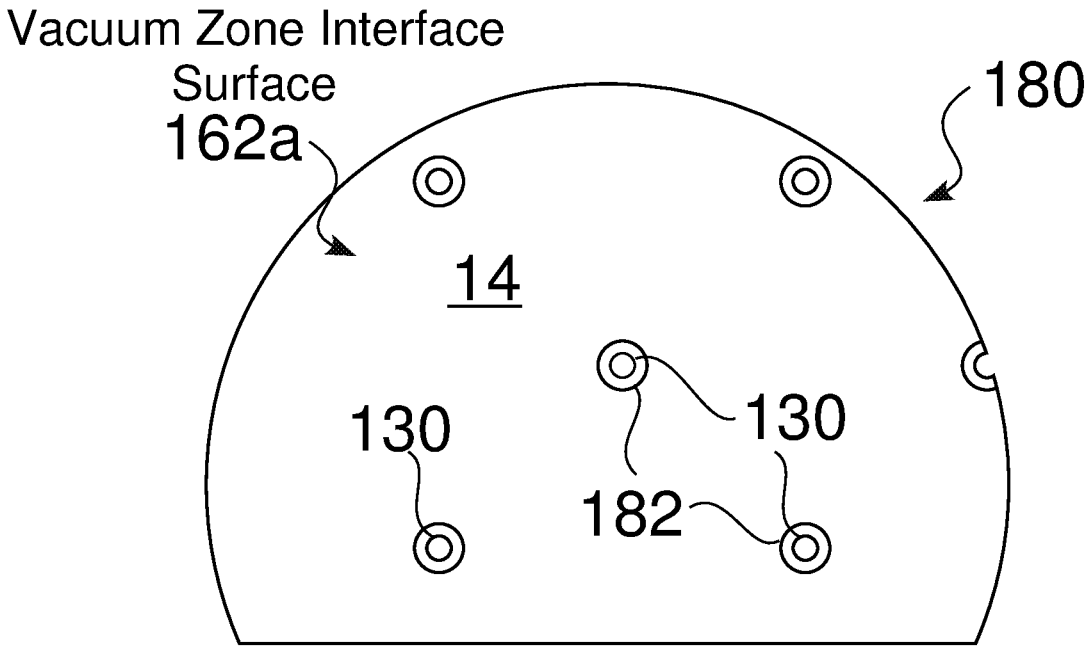
FIG. 7 shows details of a vacuum zone interface surface of an illustrative printer vacuum surface.

FIG. 6 shows details 160 of an upper planar interface 162*b* of an illustrative printer vacuum surface 14, which includes a plurality of holes or passages 130 to apply vacuum 122 to a media 62, typically through a porous transfer belt 124 that travels in the print direction 18 to transport the media 62 through the printing region 103. FIG. 7 shows details 180 of a lower planar vacuum interface 162*a* of an illustrative printer vacuum surface 14, in which the plurality of holes or passages 130 are also shown. As also seen in FIG. 7, the lower portion of the holes 130 can extend to define larger hole regions 182, such as to improve the application of vacuum 122 from movable vacuum zones 24, such as by decreasing vacuum pressure drop through the holes 130, and/or can aid in alignment between the vacuum passages 132 in the movable vacuum zones 24 and the holes 130 that extend through the printer vacuum surface 14.

The printer vacuum table 12 and printing system 102 can readily be implemented to hold a variety of media types and thicknesses, even those that have non-planar characteristics, within a given flatness range, to allow high definition printing.

Figure 8:
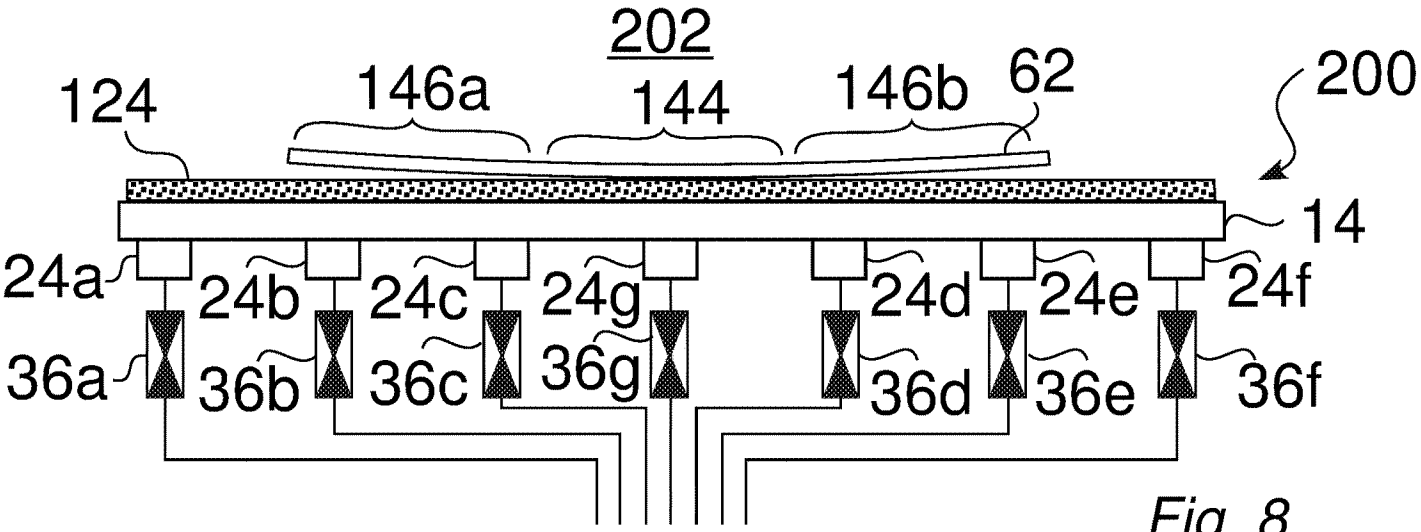
FIG. 8 is an illustrative view of media located within a printing region of a printing system having a printer vacuum table that includes a plurality of vacuum zones, in which a media to be printed has a concave upper surface.

For instance, FIG. 8 is an illustrative view 200 of media 62 located within a printing region of a printing system 102 having a printer vacuum surface 14 that includes a plurality of vacuum zones 24, e.g., 24*a*-24*g*, in which the printing surface 70*b* of the media 62 to be printed is concave 202, such that while the center 144 of the media 62 contacts the printer vacuum surface 14, the periphery 146, e.g., 146*a* and/or 146*b*, extends away from the printer vacuum surface 14, such as when no vacuum is applied 122 to any of the plurality of vacuum zones 24*a*-24*g*. Under such conditions, high definition printing 112 on the media 62 shown in FIG. 8 may not yield sufficient quality for the printed graphics 114.

Figure 9:
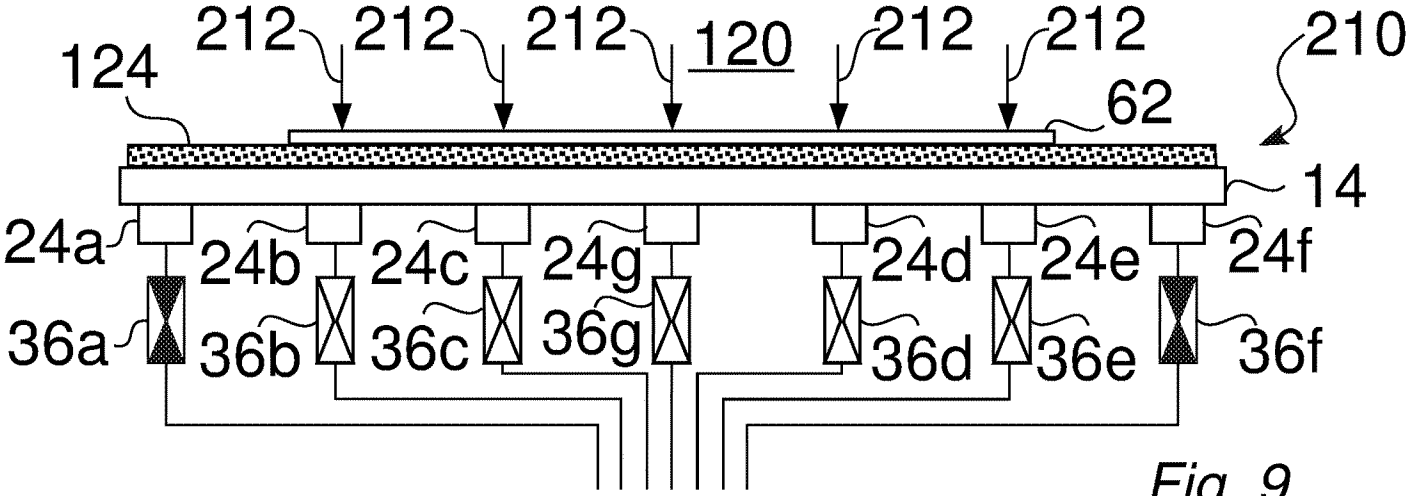
FIG. 9 is an illustrative view of the media as shown in FIG. 8 that is controllably constrained by applied vacuum to achieve a controlled flatness range.

FIG. 9 is an illustrative view 210 of the media 62 as shown in FIG. 8 that is controllably constrained 212 by applied vacuum 122 to achieve a controlled flatness range 120, to allow high definition printing. As seen in FIG. 9, vacuum zones 24*b*, 24*c*, 24*d*, 24*e* and 24*g*, which are located beneath the lower surface 70*a* of the media, are activated, such as through corresponding open valves or ports 36*b*, 36*c*, 36*d*, 36*e* and 36*g*, apply vacuum 122 to achieve an acceptable flatness range 120, to allow high definition printing. As also seen in FIG. 9, vacuum zones 24*a* and 24*f*, which do not coincide with the lower surface 70*a* of the media 62, are deactivated, such as through corresponding closed valves or ports 36*a* and 36*f*, to avoid loss of vacuum 122.

Figure 10:
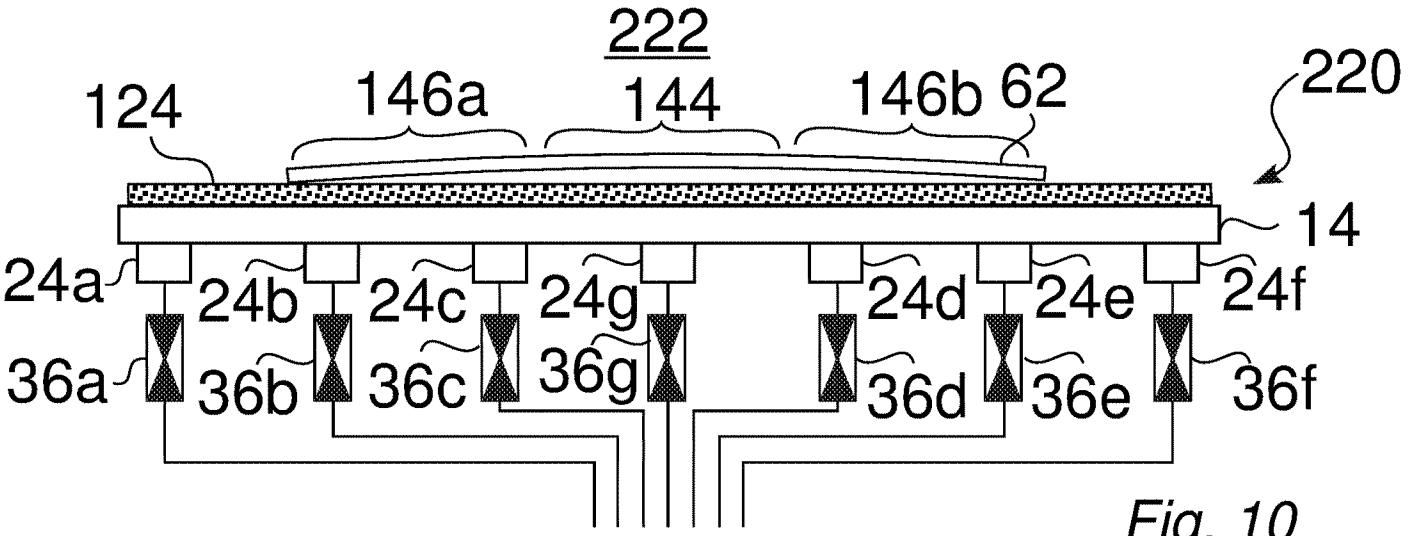
FIG. 10 is an illustrative view of media located within a printing region of a printing system having a printer vacuum table that includes a plurality of vacuum zones, in which a media to be printed has a convex upper surface.

FIG. 10 is an illustrative view 220 of media 62 located within a printing region of a printing system 102 having a printer vacuum surface 14 that includes a plurality of vacuum zones 24, e.g., 24*a*-24*g*, in which the printing surface 70*b* of the media to be printed is convex 222, such that while the center 144 of the media 62 is relatively parallel to the printer vacuum surface 14, the center 144 of the media 62 extends away from the printer vacuum surface 14, while the periphery 146, e.g., 146*a* and/or 146*b* are not parallel to the printer vacuum surface 14, such as when no vacuum is applied 122 to any of the plurality of vacuum zones 24*a*-24*g*. Under such conditions, high definition printing 112 on the media 62 shown in FIG. 10 may not yield sufficient quality for the graphics 114.

Figure 11:
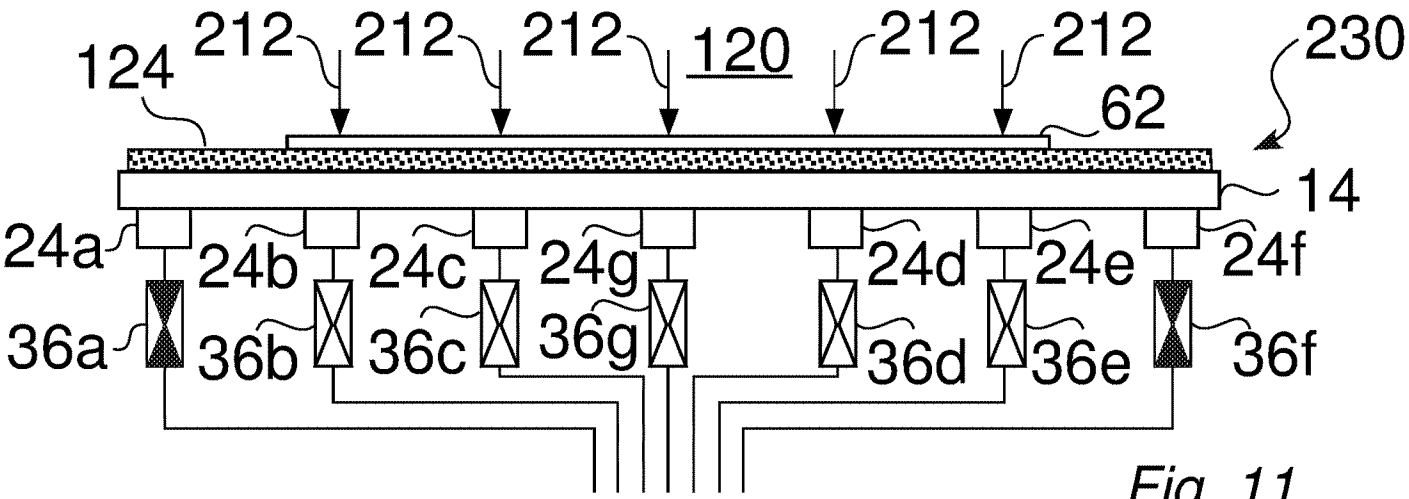
FIG. 11 is an illustrative view of the media as shown in FIG. 10 that is controllably constrained by applied vacuum to achieve a controlled flatness range.

FIG. 11 is an illustrative view 230 of the media 62 as shown in FIG. 10 that is controllably constrained 212 by applied vacuum 122 to achieve a controlled flatness range 120, to allow high definition printing 112. As seen in FIG. 11, vacuum zones 24*b*, 24*c*, 24*d*, 24*e* and 24*g*, which are located beneath the lower surface 70*a* of the media 62, are activated, such as through corresponding open valves or ports 36*b*, 36*c*, 36*d*, 36*e* and 36*g*, to apply vacuum 122 to achieve an acceptable flatness range 120, to allow high definition printing 112. As also seen in FIG. 11, vacuum zones 24*a* and 24*f*, which do not coincide with the lower surface 70*a* of the media 62, are deactivated, such as through corresponding closed valves or ports 36*a* and 36*f*, to avoid loss of vacuum 122.

Figure 12:
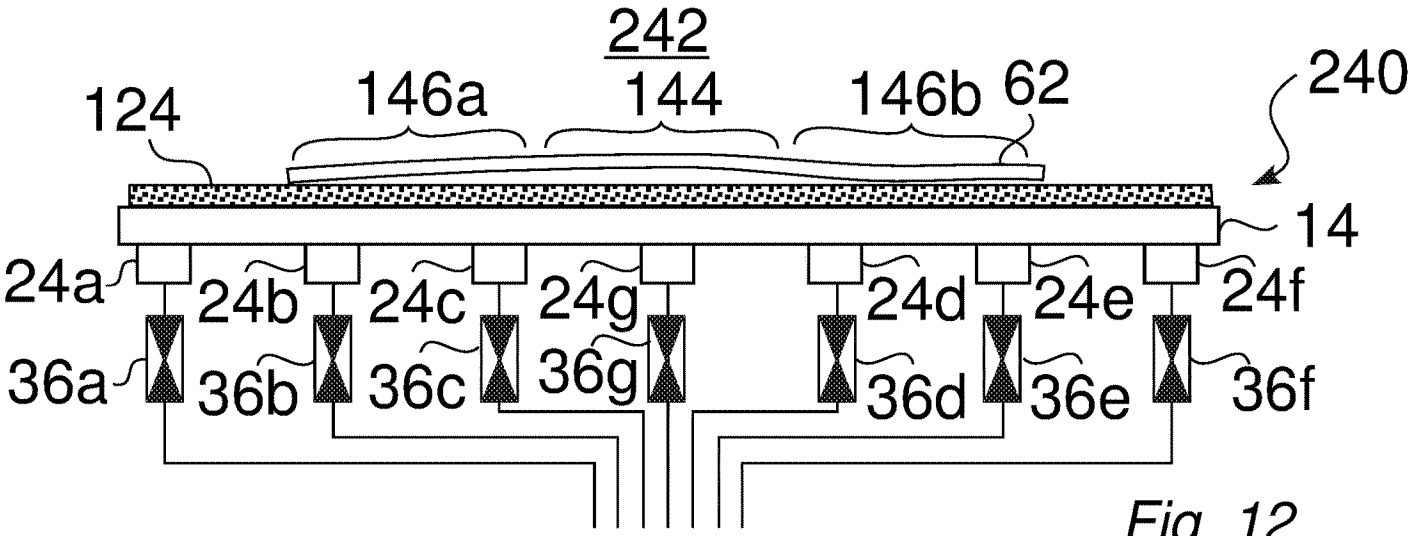
FIG. 12 is an illustrative view of media located within a printing region of a printing system having a printer vacuum table that includes a plurality of vacuum zones, in which a media to be printed includes an irregular non-planar characteristic.

FIG. 12 is an illustrative view 240 of media 62 located within a printing region of a printing system 102 having a printer vacuum surface 14 that includes a plurality of vacuum zones 24, e.g., 24*a*-24*g*, in which the printing surface 70*b* of the media 62 to be printed is irregular in shape 242, such that while one or more portions of the media 62 may relatively parallel to the printer vacuum surface 14, at least some portion of the media 62 may extend away from the printer vacuum surface 14, while other portions of the media are not parallel to the printer vacuum surface 14, such as when no vacuum is applied 122 to any of the plurality of vacuum zones 24*a*-24*g*. Under such conditions, high definition printing 112 on the media 62 shown in FIG. 10 may not yield sufficient quality for the printed graphics 114.

Figure 13:
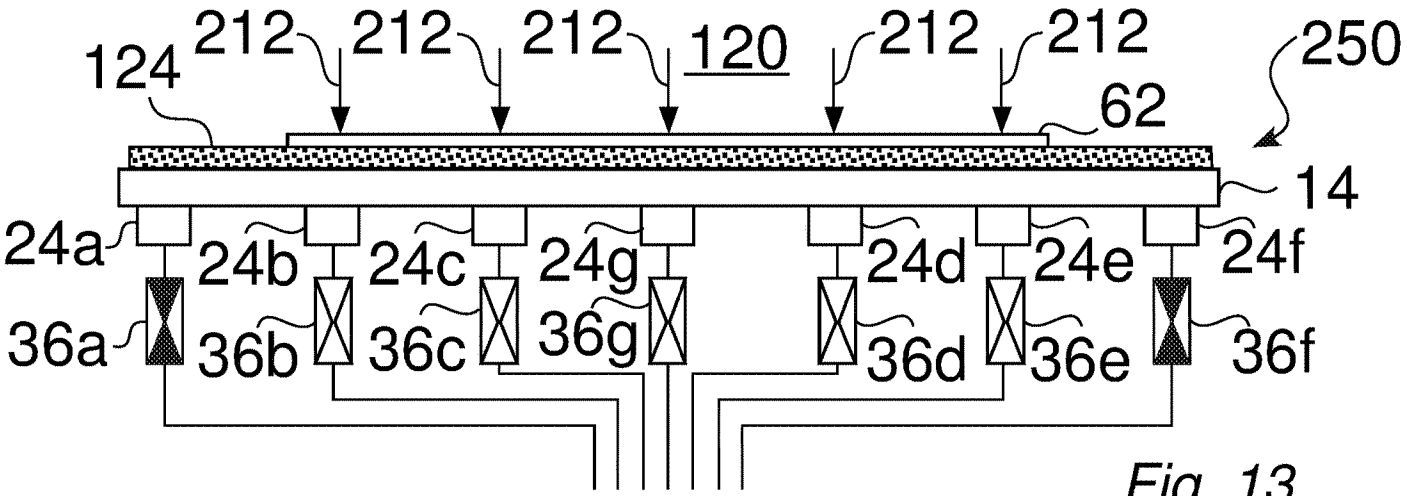
FIG. 13 is an illustrative view of the media as shown in FIG. 12 that is controllably constrained by applied vacuum to achieve a controlled flatness range.

FIG. 13 is an illustrative view 250 of the media 62 as shown in FIG. 12 that is controllably constrained 212 by applied vacuum 122 to achieve a controlled flatness range 120, to allow high definition printing 112. As seen in FIG. 13, vacuum zones 24*b*, 24*c*, 24*d*, 24*e* and 24*g*, which are located beneath the lower surface 70*a* of the media 62, are activated, such as through corresponding open valves or ports 36*b*, 36*c*, 36*d*, 36*e* and 36*g*, apply vacuum 122 to achieve an acceptable flatness range 120, to allow high definition printing. As also seen in FIG. 13, vacuum zones 24*a* and 24*f*, which do not coincide with the lower surface 70*a* of the media 62, are deactivated, such as through corresponding closed valves or ports 36*a* and 36*f*, to avoid loss of vacuum 122.

Figure 14:
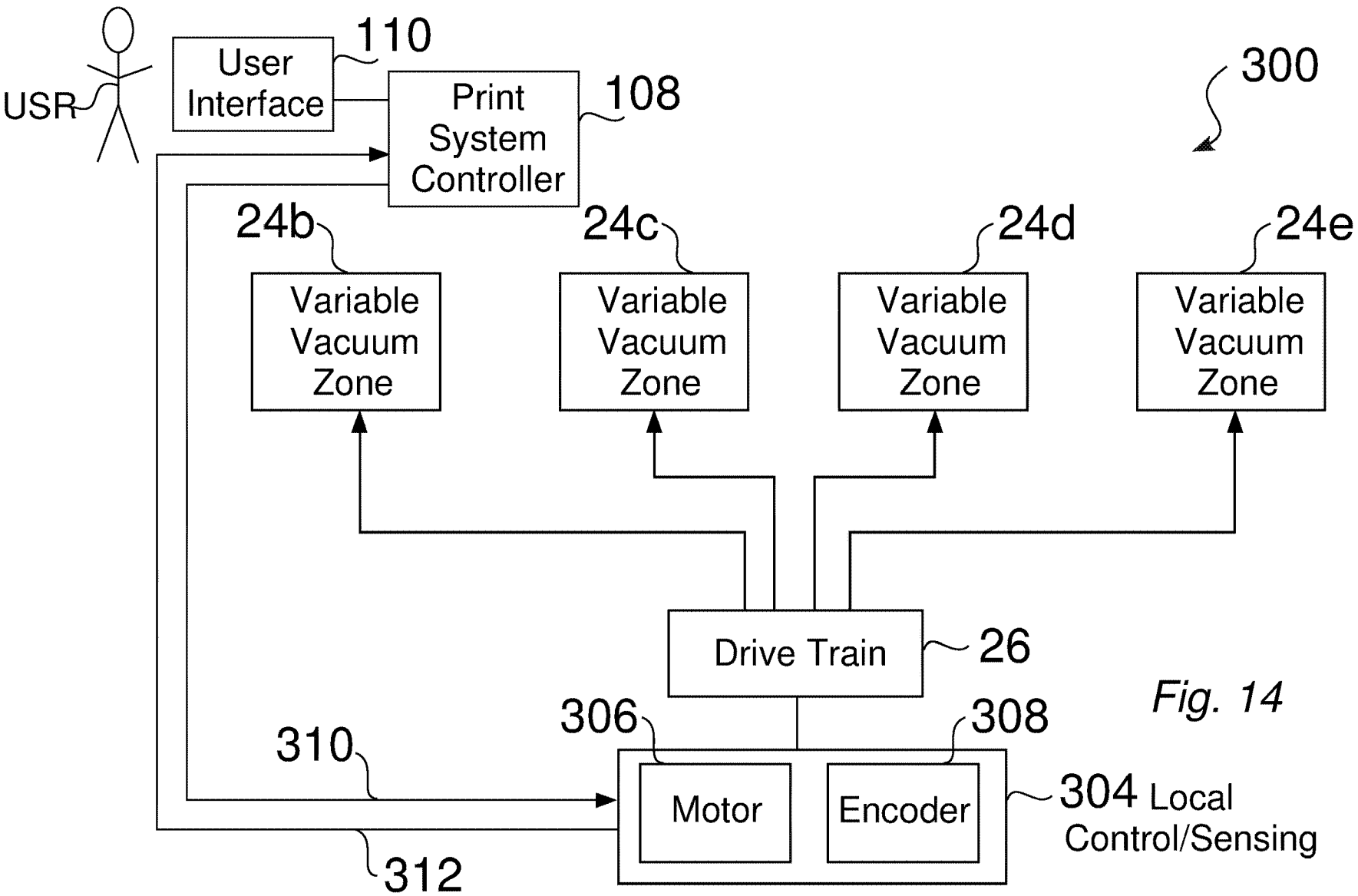
FIG. 14 is a schematic view of a system for controllably moving one or one vacuum zones for a printer vacuum table.
Figure 17:
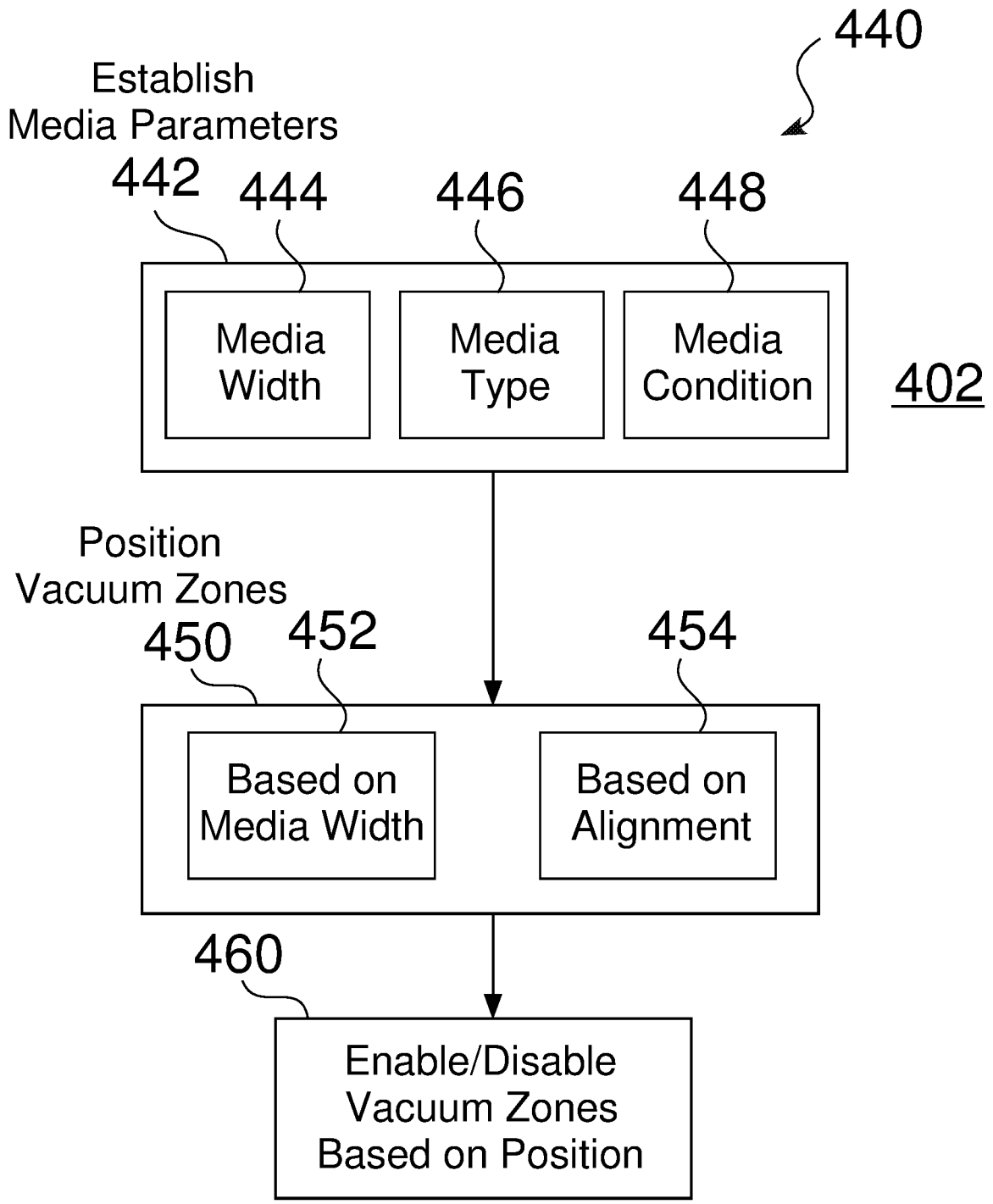
FIG. 17 is a detailed flow chart showing different operations associated with the configuration of an illustrative printer vacuum table having variable vacuum zones.

FIG. 14 is a schematic view of an illustrative system 300 for controllably moving 334, e.g., 334*b*-334*e* (FIG. 15), one or one vacuum zones 24 for a printer vacuum table 12. The illustrative drive train 26 seen in FIG. 14 can position 450 (FIG. 17) one or more vacuum zones 24, such as using a motor 306. In some system embodiments 12, the drive train is controlled 310 by a local assembly 304 and/or by the print system controller 108, such as based on establishment of media width 452 (FIG. 17) and/or media alignment 454 (FIG. 17). In some embodiments 300, the positioning of variable vacuum zones 24, e.g., 24*b*-24*e* (FIG. 1, FIG. 14) can be controlled independently, while in other embodiments 300, the positioning of one or more of the variable vacuum zones 24 may be linked, such as to provide proportional positioning 30, e.g., 30*a*, 30*b*, between the variable vacuum zones 24, such as based on rotational motion of the drive train 26 and/or linear motion 334 related to an effective diameter 326*a*, 326*b* (FIG. 15) or a corresponding circumference. In some embodiments 300, the location of the variable vacuum zones 24 can be determined by one or more encoders 308, such as linked to corresponding stepper motor position(s), in which the output from the encoder(s) 308 can provide feedback 312 to a print system controller 108, which in some embodiments 300 can be provided to the user USR through the user interface 110.

Figure 15:
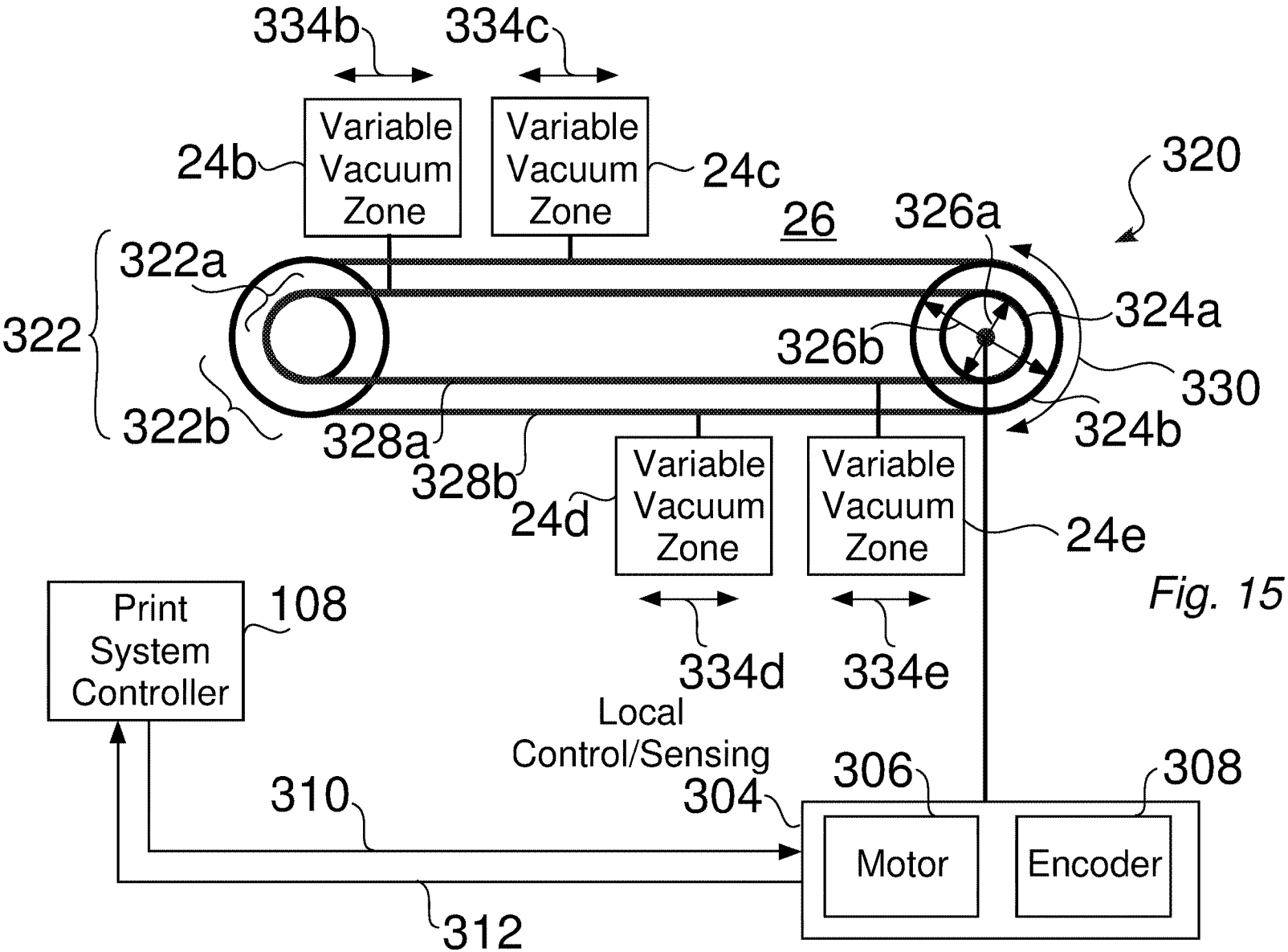
FIG. 15 is a detailed schematic view of an illustrative embodiment of a variable vacuum zone drive system.

FIG. 15 is a detailed schematic view 320 of an illustrative embodiment of a variable vacuum zone drive system 26, such as implemented in the printer vacuum table 12 seen in FIG. 1. The illustrative variable vacuum zone drive system 26 includes one or more drive assemblies 322, such as including a first drive assembly 322*a* and a second drive assembly 322*b*.

The first drive assembly 322*a* includes a first rotational element 324*a*, having a first effective diameter 326*a*, and a first linear motion element 328*a* linked to the rotational element 324*a*, wherein rotational movement 330 of the first rotational element 324*a*, such as driven by the motor 306, results in linear motion 334*b* of variable vacuum zone 24*b* and linear motion 334*e* of variable vacuum zone 24*e*. For instance, a slight counterclockwise rotational motion 330 of the first rotational element 324*a* seen in FIG. 15 results in the inward movement 334*b* and 334*e* of variable vacuum zones 24*b* and 24*e*, such as to decrease their separation 30*a* (FIG. 1).

Similarly, the same counterclockwise rotational motion 330 of the second rotational element 324*b* seen in FIG. 15 results in the inward movement 334*c* and 334*d* of variable vacuum zones 24*c* and 24*d*, such as to decrease their separation 30*b* (FIG. 1). The linear motions shown in FIG. 15 are proportional to the effective diameters 326*a* and 326*b*, resulting in a greater linear movement for variable vacuum zones 24*c* and 24*d* than that corresponding to variable vacuum zones 24*b* and 24*e*.

The illustrative variable vacuum zone drive system 26 seen in FIG. 15 can readily be set or changed to accommodate a wide variety of media 62 for printing using the printer vacuum table 12 and corresponding print system 102.

Figure 16:
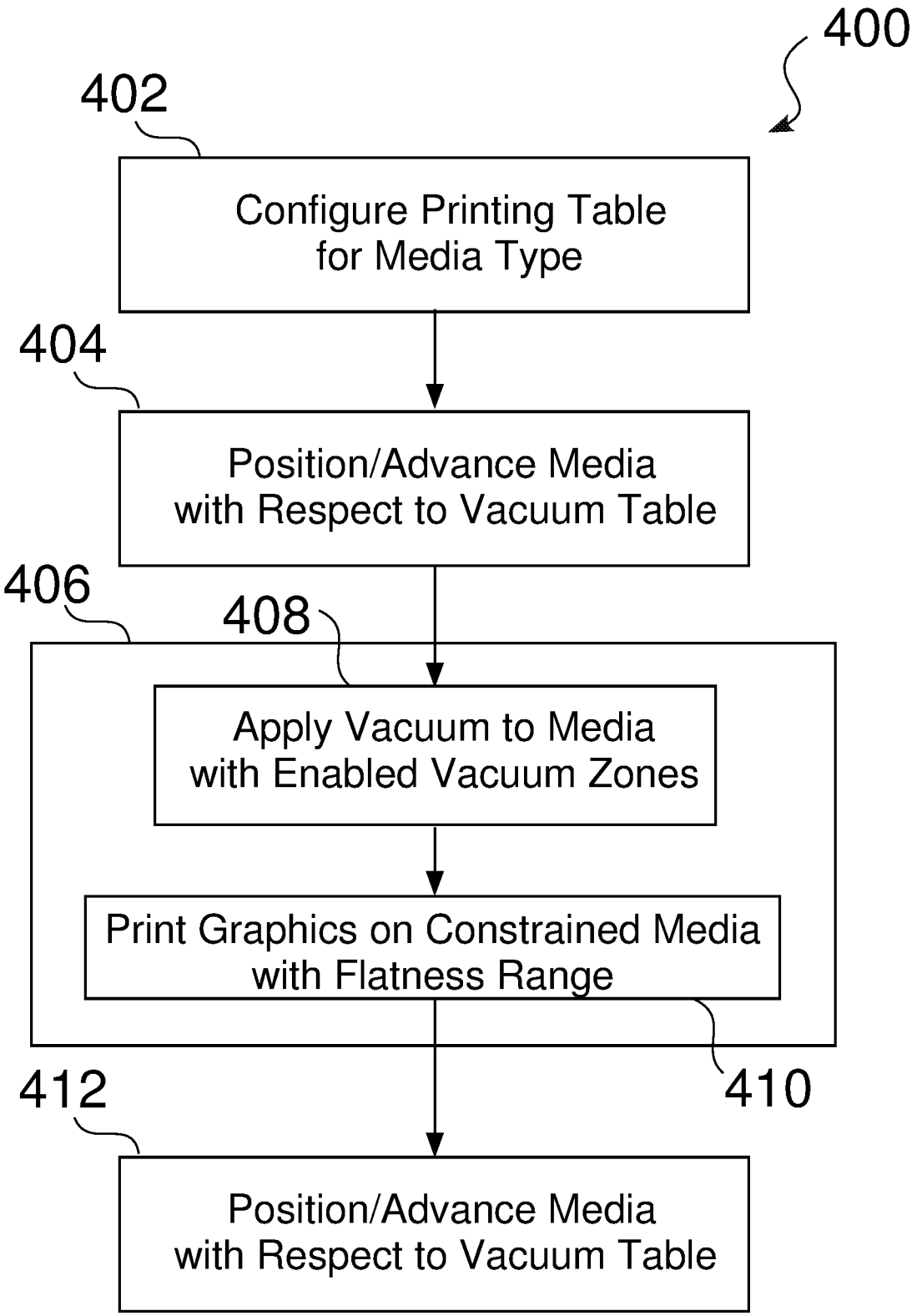
FIG. 16 is a flow chart of an illustrative method for printing on a substrate using a printer vacuum table having variable vacuum zones.

FIG. 16 is a flow chart of an illustrative method for printing on a substrate 62 using a printer vacuum table 12 having a plurality 22 of vacuum zones 24, in which one or more of the vacuum zones 24 are variable with regard to the printer vacuum surface 14. For instance, based on the type of media 62 to be used, the printer vacuum table 12 is configured 402. The media is then positioned or advanced 404 in a print direction 18, e.g., along axis 16*x* (FIG. 1), with respect to the printer vacuum table 12, such that the media 62 is located within the printing region 103 of the printer vacuum table 12. For production 406 of the printed media, such as during or after the traversal of the media 62 in the printing direction 18, the printer vacuum table applies 408 vacuum 122 to the enabled print zones 24, such as those print zones 24 that are located under the media, 62, wherein the vacuum 122 is applied to achieve an acceptable flatness 120 for printing 410 graphics 114 on the media 62, such as by the jetting of one or more inkjet inks 112, which may subsequently be cured, either within the printing region 103, or after traversal 412 from the printing region 103.

FIG. 17 is a detailed flow chart showing different illustrative operations 440 that can be associated with the configuration 402 of a printer vacuum table 12 having variable vacuum zones 24. For instance, the parameters for a media 62 to be printed 410 (FIG. 16) are established 442, such as to designate a media width value 444 and a media type value 446. A media condition value 448 may also be established, such as to designate e.g., through user interface 110, specific planarity issues, that may require increasing applied vacuum 122 through one or more vacuum zones 24 to achieve acceptable flatness 120 for printing 410 graphics 114 on the media 62.

As also seen in FIG. 17, one or more of the variable vacuum zones 24 can be positioned 450, such as based 452 on the media width value 444, and/or based 454 on the alignment of the media 62 with respect to the printer vacuum surface 14. The vacuum zones 24 can also be enabled/or disabled 460, based 452 on the media width value 444, and/or based 454 on the alignment of the media 62 with respect to the printer vacuum surface 14.

Some embodiments of the printer vacuum table 12 can be configured to provide different modes of alignment for media 62 with respect to the printer vacuum surface 14, such as for the traversal of media 62 in the print direction 18 into and out of the print region 103. As discussed above with respect to FIG. 17, the positioning and operation of one or more vacuum zones 24 can be based 454 on media alignment. As well, printing 112 and/or curing of graphics 114 is typically based on known position of the media 62, which is typically delivered into the printer region on the porous transfer belt 124, such as using sequential delivery of a single piece of media 62 at a time, i.e., for "one-up" printing 112 of graphics 114, or using sequential delivery of more than one piece of media 62, such as for "two-up" printing 112 of graphics 114 on two pieces of media 62 of the same type, size and thickness.

Figure 18:
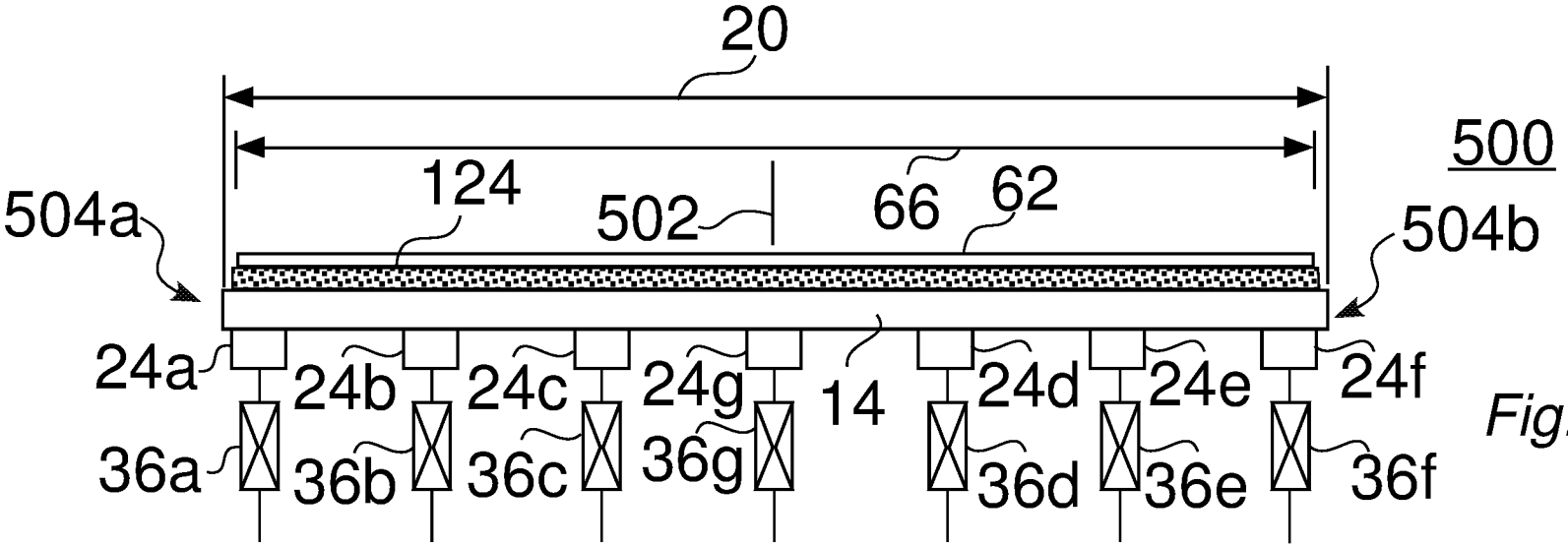
FIG. 18 is a schematic end view of a printer vacuum table having variable vacuum zones, which is configured for wide media that is centered with respect to the printer vacuum table.

FIG. 18 is a schematic end view 500 of a printer vacuum table 12 having variable vacuum zones that is configured for wide media 62, which is centered 502 with respect to the printer vacuum surface 14. As seen in FIG. 18, the media 62 can be delivered in alignment with the center of the transfer belt 124, which is also in alignment with the center of the printer vacuum surface 14. As also seen in FIG. 18, because the media 62 is wide with respect to the printer vacuum table 12, all of the print zones 24, including the fixed vacuum zones 24*a*, 24*f* and 24*g*, as well as the variable vacuum zones 24*b*-24*e*, are activated to apply vacuum 122 to achieve acceptable flatness 120 for printing 410 graphics 114 on the media 62.

Figure 19:
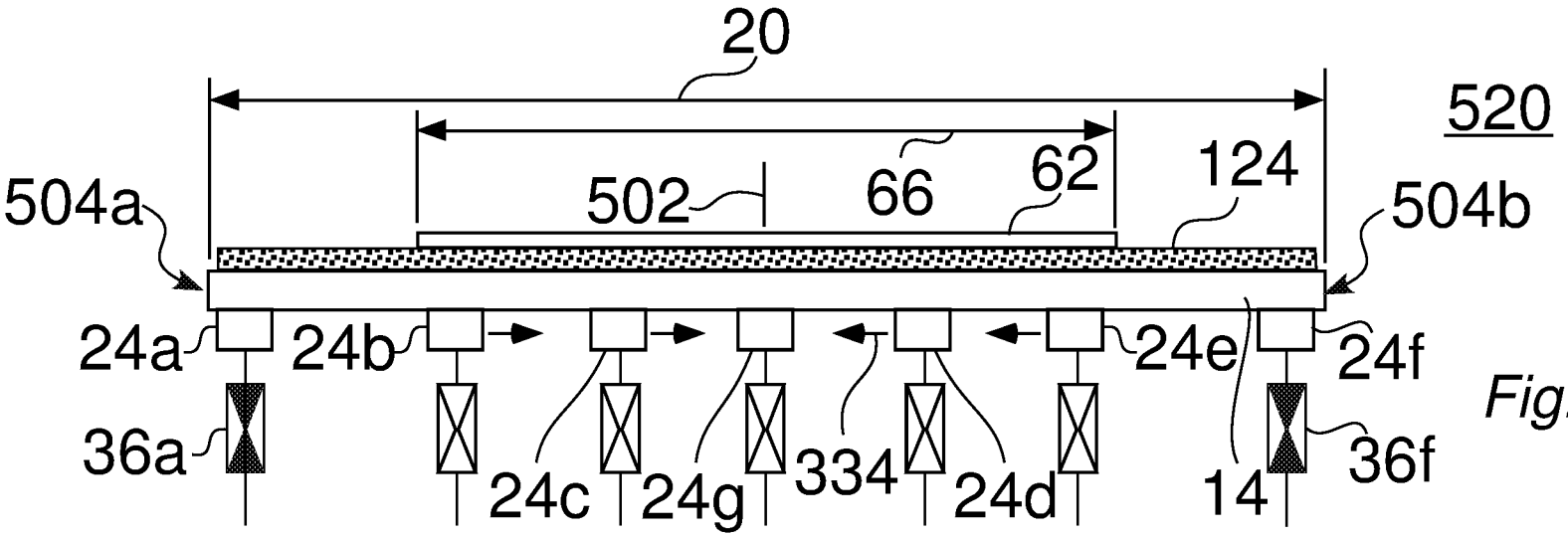
FIG. 19 is a schematic end view of a printer vacuum table having variable vacuum zones, which is configured for narrow media that is centered with respect to the printer vacuum table.

FIG. 19 is a schematic end view 520 of a printer vacuum table 12 having variable vacuum zones 24 that is configured for relatively narrow media 62, which is centered 502 with respect to both the transfer belt 124 and the printer vacuum surface 14. As also seen in FIG. 19, because the media 62 is narrow with respect to the printer vacuum table 12, the outer fixed vacuum zones 24*a* and 24*f* are prevented or disabled from applying vacuum 122, such as through closed valves or ports 36*a* and 36*f* respectively, while the variable vacuum zones 24*b*-24*d* can be moved 334 inward, such that the outer variable vacuum zones 24*b* and 24*e* are moved 334*b* (FIG. 15) and 334*e* (FIG. 15) respectively, to be located under the opposing sides of the print media 62, while the inner vacuum zones 24*c* and 24*d* are also moved inward 334*c* (FIG. 15) and 334*d* (FIG. 15) respectively, closer toward the fixed vacuum zone 24*g*, which is aligned with the center 502 of the printer vacuum surface 14. In this manner, the central fixed zone 24*g* in the printer vacuum table 12 shown in FIG. 19, as well as the variable vacuum zones 24*b*-24*e*, can be activated to apply vacuum 122 to achieve acceptable flatness 120 for printing 410 graphics 114 on the media 62.

Figure 20:
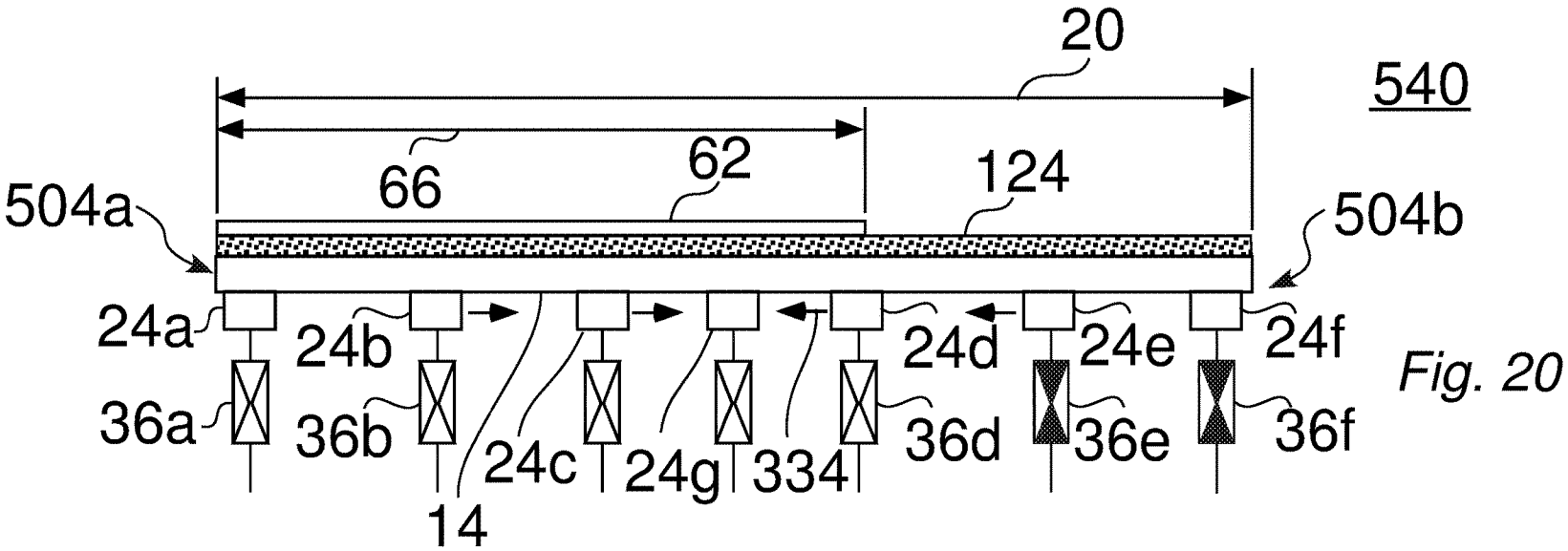
FIG. 20 is a schematic end view of a printer vacuum table having variable vacuum zones, which is configured for narrow media that is positioned on the left side of the printer vacuum table.

FIG. 20 is a schematic end view 540 of a printer vacuum table 12 having variable vacuum zones 24, in which the printer vacuum table 12 is configured 450, 460 (FIG. 17) for media 62 that is narrower than the width 20 of the printer vacuum surface 14, wherein the media 62 is controllably positioned toward the left side 504*a* of the printer vacuum surface 14 and the transfer belt 124, for traversal in the print direction 18 (FIG. 1) through the print region 103 (FIG. 3).

As seen in FIG. 20, because the width 66 (FIG. 2) the media 62 is substantially narrower than the width 20 of the printer vacuum surface 14, wherein there would otherwise be no fixed vacuum zone 24, e.g., 24*f*, or variable vacuum zone 24, e.g., 24*e*, located under the right side of the media 62, the drive system 26 of the illustrative printer vacuum table 12 shown in FIG. 20 has been activated to move 450 (FIG. 17) the variable vacuum zones 24*b*-24*e* inward 334, such that variable vacuum zone 24, e.g., 24*d*, is located under the right side of the media 62. As also seen in FIG. 20, because the width of the media 62 is smaller than the width 20 of the printer vacuum surface 14, the rightmost fixed vacuum zone 24*f*, as well as the rightmost variable vacuum zone 24*e*, are prevented or disabled 460 from applying vacuum 122, such as by closing valves or ports 36*e* and 36*f* respectively through a local controller 118 (FIG. 3) or through a print system controller 108. In this manner, the leftmost vacuum zone 24*a* and the central fixed vacuum zone 24*g*, as well as variable vacuum zones 24*b*-24*d*, can be activated to apply vacuum 122 to achieve acceptable flatness 120 for printing 410 graphics 114 on the media 62.

Figure 21:
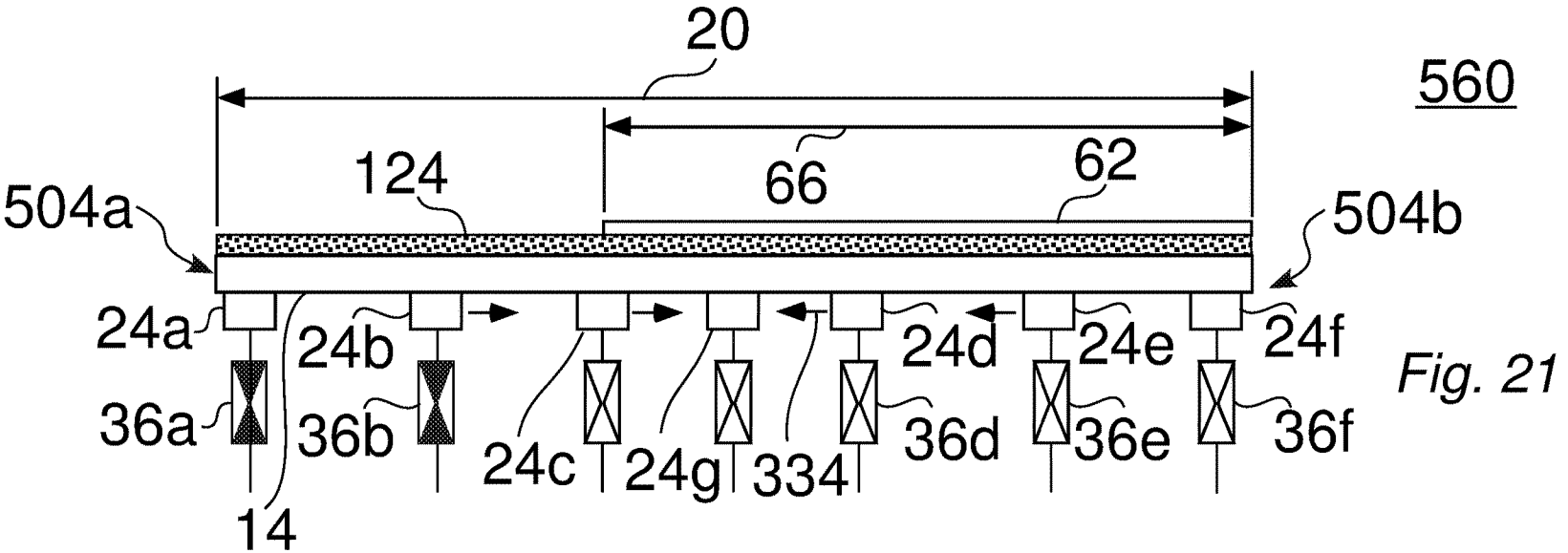
FIG. 21 is a schematic end view of a printer vacuum table having variable vacuum zones, which is configured for narrow media that is positioned on the right side of the printer vacuum table.

FIG. 21 is a schematic end view 560 of a printer vacuum table 12 having variable vacuum zones 24, in which the printer vacuum table 12 is configured 450, 460 (FIG. 17) for media 62 that is narrower than the width 20 of the printer vacuum surface 14, and in which the media 62 is controllably positioned toward the right side 504*b* of the printer vacuum surface 14, such as for traversal in the print direction 18 (FIG. 1) through the print region 103 (FIG. 3).

As seen in FIG. 21, because the width 66 (FIG. 2) the media 62 is substantially narrower than the width 20 of the printer vacuum surface 14, wherein there would otherwise be no fixed vacuum zone 24, e.g., 24*a*, or variable vacuum zone 24, e.g., 24*b*, located under the left side of the media 62, the drive system 26 of the illustrative printer vacuum table 12 shown in FIG. 21 has been activated to move 450 (FIG. 17) the variable vacuum zones 24*b*-24*e* inward 334, such that variable vacuum zone 24, e.g., 24*c*, is located under the left side of the media 62. As also seen in FIG. 21, because the width 66 of the media 62 is smaller than the width 20 of the printer vacuum surface 14, the leftmost fixed vacuum zone 24*a*, as well as the leftmost variable vacuum zone 24*b*, are prevented or disabled 460 from applying vacuum 122, such as by closing valves or ports 36*a* and 36*b* respectively through a local controller 118 (FIG. 3) or through a print system controller 108. In this manner, the rightmost fixed vacuum zone 24*f* and the central fixed vacuum zone 24*g*, as well as variable vacuum zones 24*c*-24*e*, can be activated to apply vacuum 122 to achieve acceptable flatness 120 for printing 410 graphics 114 on the media 62.

Figure 22:
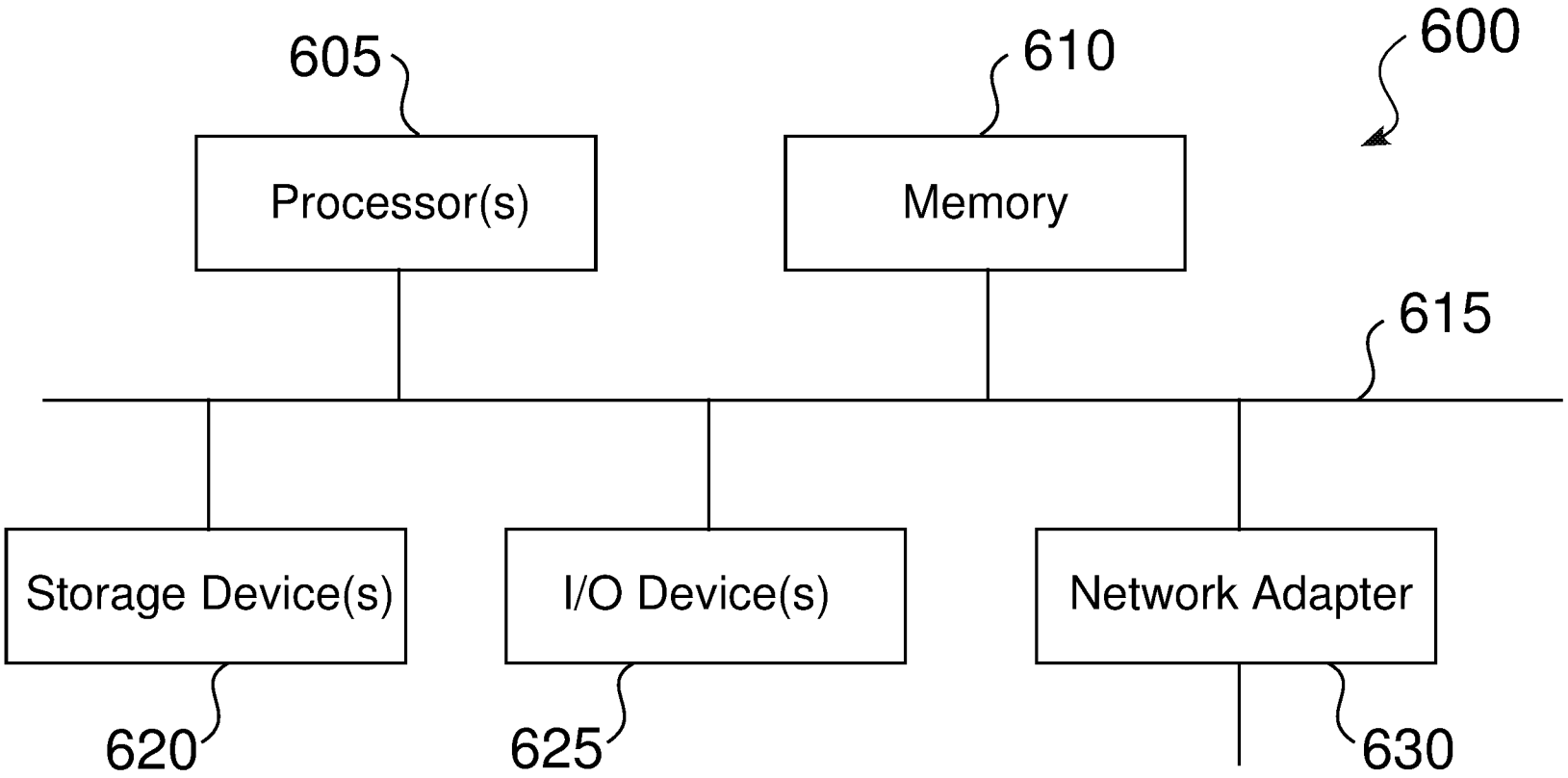
FIG. 22 is a high-level block diagram showing an example of a processing device that can represent any of the systems described herein.

FIG. 22 is a high-level block diagram showing an example of a processing device 600 that can be a part of any of the systems described above, such as the print system controller 108, the vacuum controller 118, or the drive train controller 304. Any of these systems may be or include two or more processing devices such as represented in FIG. 22, which may be coupled to each other via a network or multiple networks. In some embodiments, the illustrative processing device 600 seen in FIG. 22 can be embodies as a machine in the example form of a computer system within which a set of instructions for causing the machine to perform one or more of the methodologies discussed herein may be executed.

In the illustrated embodiment, the processing system 600 includes one or more processors 605, memory 610, a communication device and/or network adapter 630, and one or more storage devices 620 and/or input/output (I/O) devices 625, all coupled to each other through an interconnect 615. The interconnect 615 may be or include one or more conductive traces, buses, point-to-point connections, controllers, adapters and/or other conventional connection devices. The processor(s) 605 may be or include, for example, one or more general-purpose programmable microprocessors, microcontrollers, application specific integrated circuits (ASICs), programmable gate arrays, or the like, or a combination of such devices. The processor(s) 605 control the overall operation of the processing device 600. Memory 610 and/or 620 may be or include one or more physical storage devices, which may be in the form of random access memory (RAM), read-only memory (ROM) (which may be erasable and programmable), flash memory, miniature hard disk drive, or other suitable type of storage device, or a combination of such devices. Memory 610 and/or 620 may store data and instructions that configure the processor(s) 605 to execute operations in accordance with the techniques described above. The communication device 630 may be or include, for example, an Ethernet adapter, cable modem, Wi-Fi adapter, cellular transceiver, Bluetooth transceiver, or the like, or a combination thereof. Depending on the specific nature and purpose of the processing device 600, the I/O devices 625 can include devices such as a display (which may be a touch screen display), audio speaker, keyboard, mouse or other pointing device, microphone, camera, etc.

Unless contrary to physical possibility, it is envisioned that (i) the methods/steps described above may be performed in any sequence and/or in any combination, and that (ii) the components of respective embodiments may be combined in any manner.

The printer vacuum table and printer system techniques introduced above can be implemented by programmable circuitry programmed/configured by software and/or firmware, or entirely by special-purpose circuitry, or by a combination of such forms. Such special-purpose circuitry (if any) can be in the form of, for example, one or more application-specific integrated circuits (ASICs), programmable logic devices (PLDs), field-programmable gate arrays (FPGAs), etc.

Software or firmware to implement the techniques introduced here may be stored on a machine-readable storage medium and may be executed by one or more general-purpose or special-purpose programmable microprocessors. A "machine-readable medium", as the term is used herein, includes any mechanism that can store information in a form accessible by a machine (a machine may be, for example, a computer, network device, cellular phone, personal digital assistant (PDA), manufacturing tool, or any device with one or more processors, etc.). For example, a machine-accessible medium includes recordable/non-recordable media, e.g., read-only memory (ROM); random access memory (RAM); magnetic disk storage media; optical storage media; flash memory devices; etc.

Those skilled in the art will appreciate that actual data structures used to store this information may differ from the figures and/or tables shown, in that they, for example, may be organized in a different manner; may contain more or less information than shown; may be compressed, scrambled and/or encrypted; etc.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

What is claimed is:

1. A printer vacuum table for a printing application, comprising:

a printer vacuum table surface having a characteristic length in a first direction and a characteristic width in a second direction perpendicular to the first direction, and having a lower planar side and an upper planar side opposite the lower planar side, wherein the length of the printer vacuum table surface extends from a first end to a second end;

wherein the printer vacuum table surface includes passages defined between the upper planar side and the lower planar side;

a plurality of printer vacuum zones proximate to the lower planar side of the printer vacuum table surface, wherein the plurality of printer vacuum zones extend in the first direction and are located at different positions in the second direction, wherein the plurality of the printer vacuum zones includes a first pair of vacuum zones and a second pair of vacuum zones, and wherein the first pair of vacuum zones and the second pair of vacuum zones are movable in the second direction to position the vacuum zones coincident with a media and independent of a printer carriage position;

a plurality of vacuum seals affixed to the plurality of printer vacuum zones proximate to the lower planar side of the printer vacuum table surface, wherein the plurality of vacuum seals are movable in the second direction with respect to the lower planar side of the printer vacuum table surface, and wherein the plurality of vacuum seals are configured to reduce or eliminate leakage of variable vacuum that is applied to the printer vacuum table surface;

a drive train that is configured for proportional movement of the first pair of vacuum zones and the second pair of vacuum zones in the second direction, wherein the proportional movement is related to any of an effective diameter or a circumference of a rotational element of the drive train; and wherein conduits are defined through the plurality of printer vacuum zones, wherein the conduits are connectable to a vacuum source, and wherein the vacuum source is controllably activatable to apply variable vacuum to each of the passages in the printer vacuum table surface, to control a flatness range of the media by selectively holding the media to the upper planar side of the printer vacuum table surface via a porous media transport belt coincident with the plurality of printer vacuum zones;

wherein the variable vacuum applied to each of the passages is independently variable, such that an amount of variable vacuum applied to one passage is different than at least an amount of variable vacuum applied to another passage; and wherein variable vacuum applied to each of the plurality of printer vacuum zones can be turned off when the media does not cover a corresponding region of the printer vacuum table surface.

2. The printer vacuum table of claim 1, wherein the applied vacuum is configured to hold the media within a given flatness range to allow printing on the held media.

3. The printer vacuum table of claim 1, wherein at least two of the vacuum zones are fixed at opposing sides of the width of the printer vacuum table surface.

4. The printer vacuum table of claim 1, wherein the position of a plurality of the vacuum zones is movable in the second direction.

5. The printer vacuum table of claim 1, wherein each of the vacuum zones can be controlled for vacuum on or off.

6. The printer vacuum table of claim 1, wherein the first pair of vacuum zones and the second pair of vacuum zones are proportionally movable in the second direction based on rotational movement of the rotational element of the drive train.

7. The printer vacuum table of claim 6, wherein the drive train is configured to move the first pair of vacuum zones and the second pair of vacuum zones concurrently with respect to the width of the printer vacuum table surface.

8. The printer vacuum table of claim 7, wherein the drive train is controllable based on the width and alignment of the media with respect to the printer vacuum table surface.

9. The printer vacuum table of claim 1, wherein the printer is configured for single pass printing on the media.

10. A printing system comprising:

a printing system controller including a processor;

a print carriage including a plurality of print heads;

a printer vacuum table;

a vacuum delivery system; and a porous transfer belt for transporting media though a printing region defined between the printer vacuum table and the print carriage;

wherein the printer vacuum table includes:

a printer vacuum table surface having a characteristic length in a first direction and a characteristic width in a second direction perpendicular to the first direction, and having a lower planar side and an upper planar side opposite the lower planar side, wherein the length of the printer vacuum table surface extends from a first end to a second end;

wherein the printer vacuum table surface includes passages between the upper planar side and the lower planar side;

a plurality of printer vacuum zones proximate to the lower planar side of the printer vacuum table surface, wherein the plurality of printer vacuum zones extend in the first direction and are located at different positions in the second direction, wherein the plurality of the printer vacuum zones includes a first pair of vacuum zones and a second pair of vacuum zones, and wherein the first pair of vacuum zones and the second pair of vacuum zones are movable in the second direction to position the vacuum zones coincident with a media and independent of a printer carriage position;

a plurality of vacuum seals affixed to the plurality of printer vacuum zones proximate to the lower planar side of the printer vacuum table surface, wherein the plurality of vacuum seals are movable in the second direction with respect to the lower planar side of the printer vacuum table surface, and wherein the plurality of vacuum seals are configured to reduce or eliminate leakage of variable vacuum that is applied to the printer vacuum table surface;

a drive train that is configured for proportional movement of the first pair of vacuum zones and the second pair of vacuum zones in the second direction, wherein the proportional movement is related to any of an effective diameter or a circumference of a rotational element of the drive train; and wherein conduits are defined through the plurality of printer vacuum zones, wherein the conduits are connectable to the vacuum delivery system, and wherein variable vacuum from the vacuum delivery system is controllably activatable by the printer controller to apply variable vacuum to each of the passages in the printer vacuum table surface, to control a flatness range of the media by selectively holding the media to the upper planar side of the printer vacuum table surface via the porous transfer belt coincident with the plurality of printer vacuum zones;

wherein the variable vacuum applied to the passages is varied such that an amount of variable vacuum applied to each of the passages is independently variable, such that one passage is different than at least an amount of variable vacuum applied to another passage; and wherein variable vacuum applied to each of the plurality of printer vacuum zones can be turned off when the media does not cover a corresponding region of the printer vacuum table surface.

11. The printing system of claim 10, wherein the applied vacuum is configured to hold the media within a given flatness range to allow printing on the held media.

12. The printing system of claim 10, wherein at least two of the vacuum zones are fixed at opposing sides of the width of the printer vacuum table surface.

13. The printing system of claim 10, wherein the position of a plurality of the vacuum zones is movable in the second direction.

14. The printing system of claim 10, wherein each of the vacuum zones can be controlled for vacuum on or off.

15. The printing system of claim 10, wherein the first pair of vacuum zones and the second pair of vacuum zones are proportionally movable in the second direction based on rotational movement of the rotational element of the drive train.

16. The printing system of claim 15, wherein the drive train is configured to move the first pair of vacuum zones and the second pair of vacuum zones concurrently with respect to the width of the printer vacuum table surface.

17. The printing system of claim 16, wherein the drive train is controllable based on the width and alignment of the media with respect to the printer vacuum table surface.

18. The printing system of claim 10, wherein the printer is configured for single pass printing on the media.

19. The printer vacuum table of claim 1, wherein the positioning of each of the plurality of printer vacuum zones is independently controllable.

20. The printer vacuum table of claim 1, wherein the drive train is further configured to move the first and second pairs of vacuum zones based on a width of the media.

21. The printing system of claim 10, further comprising:

a plurality of valves that are connected between a vacuum source of each of the plurality of printer vacuum zones, wherein each valve corresponds to a respective printer vacuum zone of the plurality of printer vacuum zones, and wherein each valve is independently actuatable to controllably vary vacuum applied by the respective printer vacuum zone.

* * * * *